US007644698B2

(12) United States Patent
Shiraishi et al.

(10) Patent No.: US 7,644,698 B2
(45) Date of Patent: Jan. 12, 2010

(54) NON-EQUILIBRIUM PLASMA DISCHARGE TYPE IGNITION DEVICE

(75) Inventors: Taisuke Shiraishi, Yokohama (JP); Tomonori Urushihara, Yokohama (JP); Eiji Takahashi, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 12/173,508

(22) Filed: Jul. 15, 2008

(65) Prior Publication Data

US 2009/0031988 A1 Feb. 5, 2009

(30) Foreign Application Priority Data

Aug. 2, 2007 (JP) ..... 2007-201985

(51) Int. Cl.
*F02P 5/145* (2006.01)
*F02P 3/01* (2006.01)

(52) U.S. Cl. ..... 123/406.19; 123/146.5 R; 123/90.15

(58) Field of Classification Search ..... 123/260, 123/266, 262, 283, 634, 647, 143 R, 169 EL, 123/90.15, 146.5 R, 406.19, 183; 313/141–144, 313/118

See application file for complete search history.

(56) References Cited

U.S. PATENT DOCUMENTS 3,954,093 A * 5/1976 Hughes ..... 123/143 A
3,974,412 A 8/1976 Pratt, Jr.
5,469,013 A 11/1995 Kang
5,705,892 A 1/1998 Codina et al.
6,335,587 B1 * 1/2002 Matsubara ..... 313/141
6,460,506 B1 * 10/2002 Nevinger ..... 123/260
7,082,920 B2 * 8/2006 Robinet et al. ..... 123/260
7,278,387 B2 * 10/2007 Gong et al. ..... 123/169 MG
7,449,823 B2 * 11/2008 Menken et al. ..... 313/141
2004/0100179 A1 * 5/2004 Boley et al. ..... 313/143
2007/0283916 A1 12/2007 Bachmaier et al.

FOREIGN PATENT DOCUMENTS

DE 100 37 536 A1 2/2002
EP 1515408 A2 3/2005
JP 10-141191 A 5/1998
WO WO 2004/063560 A1 7/2004
WO WO 2006/018379 A1 2/2006

* cited by examiner

*Primary Examiner*—Stephen K Cronin
*Assistant Examiner*—Johnny H Hoang
(74) *Attorney, Agent, or Firm*—Foley & Lardner LLP

(57) ABSTRACT

An ignition device performs spark ignition to a fuel mixture in a combustion chamber (13) of an internal combustion engine (100, 101) by using a spark plug (50). The spark plug (50) includes a first electrode (51), a second electrode (52, 11*a*, 11*b*, 21), and an insulating member (53, 11*c*) which is formed from dielectric substance and interposed between the first electrode (51) and the second electrode (52, 11*a*, 21). By impressing an alternating current between the first electrode (51) and the second electrode (52, 11*a*, 21), non-equilibrium plasma discharge between the insulating member (53, 11*c*) and one of the first electrode (51) and the second electrode (52, 11*a*, 21) is promoted. Igniting the fuel mixture by the non-equilibrium plasma discharge achieves a high ignition performance is achieved with low energy consumption.

8 Claims, 23 Drawing Sheets

NON-EQUILIBRIUM PLASMA DISCHARGE TYPE IGNITION DEVICE

FIELD OF THE INVENTION

This invention relates to an ignition device which ignites a fuel mixture to be combusted by an internal combustion engine by non-equilibrium plasma discharge.

BACKGROUND OF THE INVENTION

JPH 10-141191A published by the Japan Patent Office in 1996 proposes an ignition device which ignites a fuel mixture in a combustion chamber of an internal combustion engine through application of non-equilibrium plasma discharge. The non-equilibrium plasma discharge is also called low-temperature plasma discharge or corona discharge.

The ignition device according to the prior art comprises two electrodes which effect a high-voltage discharge in the combustion chamber, and a pulse power source portion for impressing a short-pulse-width high-voltage alternating current between the electrodes to cause the non-equilibrium plasma discharge between the electrodes, and then generates equilibrium plasma discharge due to thermalization plasma, thereby igniting the fuel mixture in the combustion chamber. The equilibrium plasma discharge due to the thermalization plasma is also called high-temperature plasma discharge or arc discharge.

SUMMARY OF THE INVENTION

In the ignition device according to the prior art, the discharge mode undergoes transition from the non-equilibrium plasma discharge to the equilibrium plasma discharge. During the non-equilibrium plasma discharge, the value of an electric current flowing between the electrodes is small, and it is possible to form high-energy electrons with low consumption energy. After the transition to the equilibrium plasma discharge, however, a large quantity of electric current flows through a portion bridged by the equilibrium plasma discharge. According to the prior art ignition device, although the ignition performance is improved, an increase in power consumption due to the discharge is inevitable.

It is therefore an object of this invention to realize a desired ignition performance with low energy consumption, and to expand a lean burn limit of an internal combustion engine.

In order to achieve the above object, this invention provides an ignition device which performs a spark ignition of a fuel mixture in a combustion chamber of an internal combustion engine. The device comprises a first electrode, a second electrode, and an insulating member which is formed from dielectric substance and interposed between the first electrode and the second electrode. The insulating member promotes non-equilibrium plasma discharge between the dielectric and one of the first electrode and the second electrode when an alternating current is impressed between the first electrode and the second electrode.

The details as well as other features and advantages of this invention are set forth in the remainder of the specification and are shown in the accompanying drawings.

DESCRIPTION OF THE PREFERRED EMBODIMENTS

Figure 1:
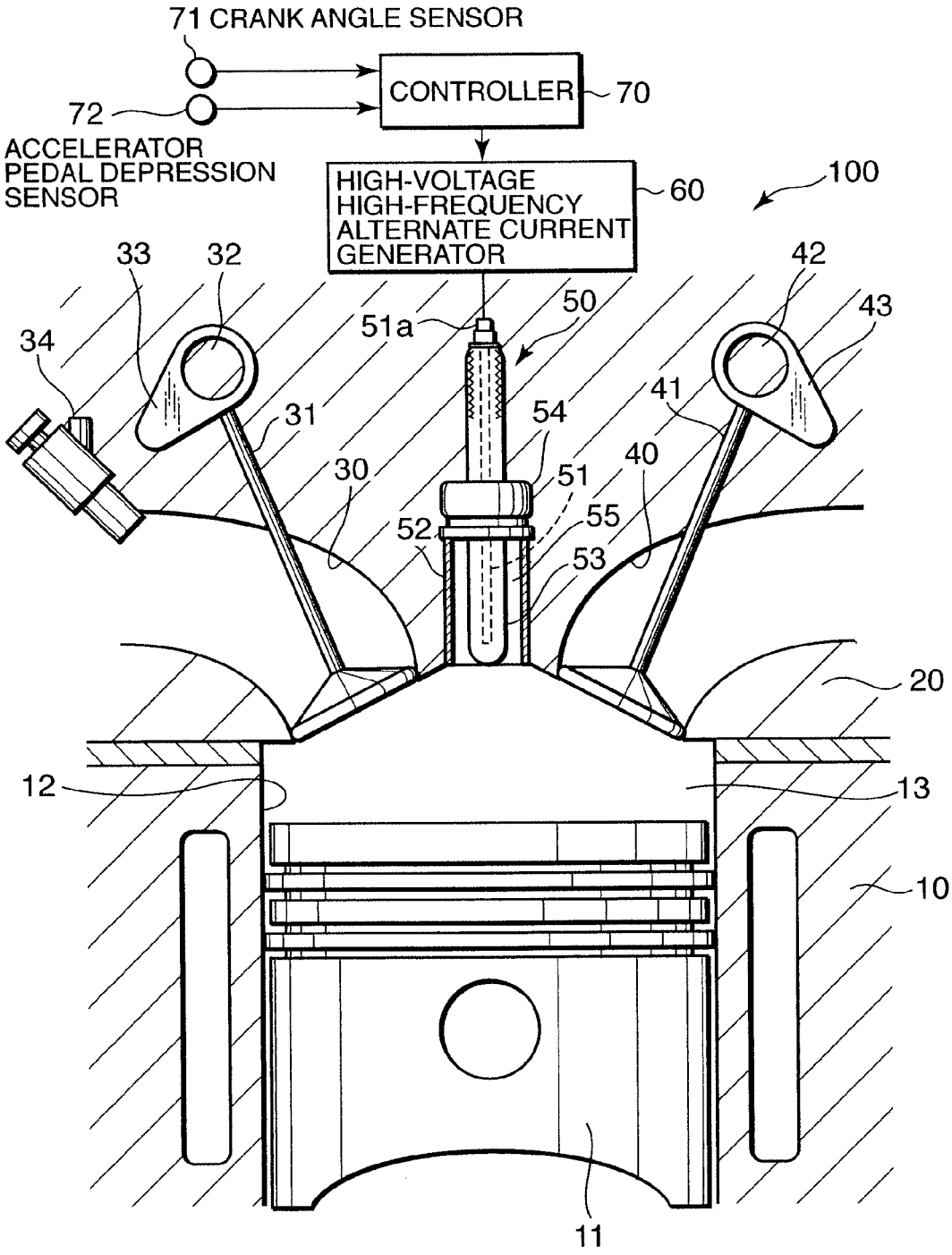
FIG. 1 is an enlarged schematic longitudinal sectional view of essential parts of an internal combustion engine, illustrating the construction of an ignition device according to this invention.

Referring to FIG. 1 of the drawings, a non-equilibrium plasma discharge type vehicle internal combustion engine 100 comprises a cylinder block 10, and a cylinder head 20 provided on the upper side of the cylinder block 10. The internal combustion engine 100 is a four-stroke-cycle multi-cylinder engine.

A cylinder 12 is formed in the cylinder block 10 to accommodate a piston 11. A combustion chamber 13 is formed by a crown surface of the piston 11, a wall surface of the cylinder 12, and a bottom surface of the cylinder head 20. When fuel mixture burns in the combustion chamber 13, the piston 11 reciprocates within the cylinder 12 under a combustion pressure.

An intake port 30 for supplying fuel mixture to the combustion chamber 13 and an exhaust port 40 for expelling exhaust gas from the combustion chamber 13 are formed in the cylinder head 20.

The intake port 30 is equipped with an intake valve 31. The intake valve 31 is driven by a cam 33 formed integrally with an intake camshaft 32, and opens and closes the intake port 30 as the piston 11 moves up and down. A fuel injector 34 for injecting fuel is installed in the intake port 30.

The exhaust port 40 is equipped with an exhaust valve 41. The exhaust valve 41 is driven by a cam 43 formed integrally with an exhaust camshaft 42, and opens and closes the exhaust port 40 as the piston 11 moves up and down. An exhaust passage for discharging exhaust gas to the exterior is connected to the exhaust port 40, and an exhaust gas recirculation (EGR) device connected to the exhaust passage causes a part of the exhaust gas to be recirculated into a flow of the intake air which is aspirated into the combustion chamber 13 through the intake port 30.

A spark plug 50 is installed between the intake port 30 and the exhaust port 40 of the cylinder head 20 so as to face the combustion chamber 13. The spark plug 50 is equipped with a center electrode 51 as a first electrode, a cylindrical electrode 52 as a second electrode, an insulating member 53, and an outer shell 54, and is adapted to ignite fuel mixture through the non-equilibrium plasma discharge.

The spark plug 50 is accommodated in a recess formed in the cylinder head 20, and is fixed to the cylinder head 20 via an outer shell 54 provided at the center in the axial direction. An ignition chamber 55 communicating with the combustion chamber 13 is formed between the insulating member 53 and the cylindrical electrode 52 of the spark plug 50.

The cylindrical electrode 52 is formed of a conductive material, and protrudes downwards from the outer shell 54. The insulating member 53 comprises a capsule-like dielectric substance, and extends vertically through the outer shell 54 to protrude into the cylindrical electrode 52. The center electrode 51 is formed of a bar-like conductor, and is arranged on the inner side of the insulating member 53. An annular gap between the cylindrical electrode 52 and the insulating member 53 forms the ignition chamber 55.

The cylinder block 10, the piston 11, and the cylinder head 20 are all formed of a conductive material, and are connected to the ground. The cylindrical electrode 52 is connected to the ground via the cylinder head 20.

A terminal 51*a* is mounted to the upper end of the center electrode 51. A high-voltage/high-frequency alternate current generator 60 is connected to the terminal 51*a*. The high-voltage/high-frequency alternate current generator 60 impresses an alternating current according to the engine operation state between the terminal 51*a* and the ground.

The high-voltage/high-frequency alternate current generator 60 is controlled by a controller 70. The controller 70 is constituted by a microcomputer comprising a central processing unit (CPU), a read-only memory (ROM), a random access memory (RAM), and an input/output interface (I/O interface). The controller 70 may be constituted by a plurality of microcomputers.

Detection data from a crank angle sensor 71 for producing a crank angle signal for each predetermined crank angle of the internal combustion engine 100, and an accelerator pedal depression sensor 72 for detecting the operating amount of an accelerator pedal provided in the vehicle are input into the controller 70 as signals.

The crank angle signal is used as a signal representative of an engine rotation speed of the internal combustion engine 100. The operating amount of the accelerator pedal is used as a signal representative of an engine load of the internal combustion engine 100.

Based on these input signals, the controller 70 controls a voltage value, an impression time period, a frequency, and an impression timing of the alternating current output from the high-voltage/high-frequency alternate current generator 60 to control the ignition of the spark plug 50 and the discharge energy of the non-equilibrium plasma discharge.

In the internal combustion engine 100, the fuel injector 34 injects fuel into the intake port 30. When the piston 11 moves downwards, the pressure in the combustion chamber 13 becomes lower than the pressure in the intake port 30. When the intake valve 31 is opened in this state, fuel mixture flows from the intake port 30 into the combustion chamber 13 due to the difference in pressure between the intake port 30 and the combustion chamber 13.

After the intake valve 31 is closed, the fuel mixture is compressed due to the rise of the piston 11, and a portion of the fuel mixture flows into the ignition chamber 55. Immediately before the piston 11 reaches the compression top dead center, the fuel mixture which has flowed into the ignition chamber 55 is ignited through the non-equilibrium plasma discharge of the spark plug 50. In this way, the flame generated in the ignition chamber 55 is propagated to the combustion chamber 13 to burn the fuel mixture in the combustion chamber 13.

Next, the non-equilibrium plasma discharge of the spark plug 50 will be described.

Figure 2:
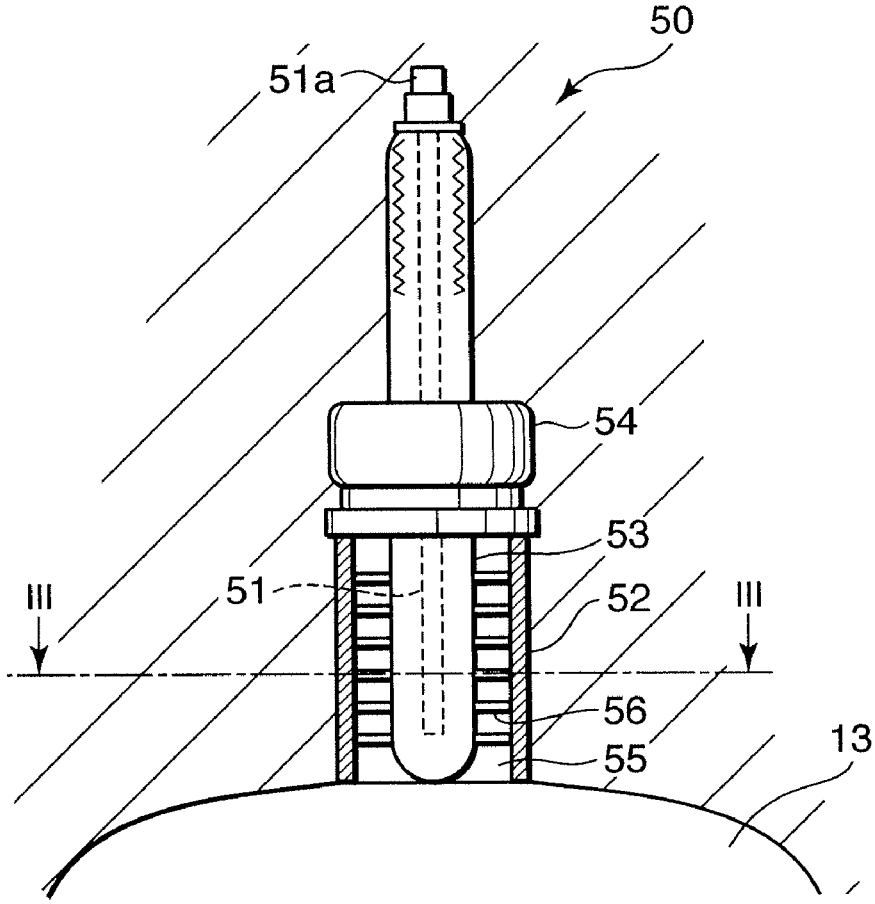
FIG. 2 is a side view, inclusive of a partial longitudinal sectional view, of a spark plug according to this invention.
Figure 3:
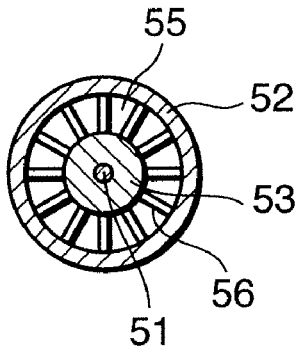
FIG. 3 is a cross-sectional view of the spark plug taken along the line III-III of FIG. 2.

Referring to FIGS. 2 and 3, when an alternating current is impressed to the spark plug 50 by the high-voltage/high-frequency alternate current generator 60, the spark plug 50 effects a transitional non-equilibrium plasma discharge, or in other words dielectric barrier discharge, between the insulating member 53 and the cylindrical electrode 52 preceding the equilibrium plasma discharge. As a result, a number of streamers 56 are generated in both the axial direction and the radial direction.

By forming a number of streamers 56 in the ignition chamber 55, the spark plug 50 increases the electron temperature of the ignition chamber 55 to thereby enhance the molecular activity thereof. As a result, there is realized simultaneous ignition at a number of points in a large ignition space. This type of ignition will be referred to as volumetric ignition.

Figure 4A:
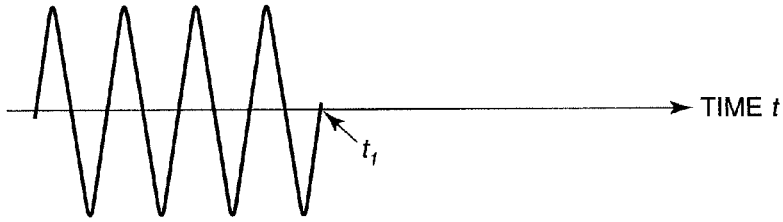
FIGS. 4A-4D are diagrams illustrating a method of increasing the discharge energy of the non-equilibrium plasma discharge.
Figure 4B:
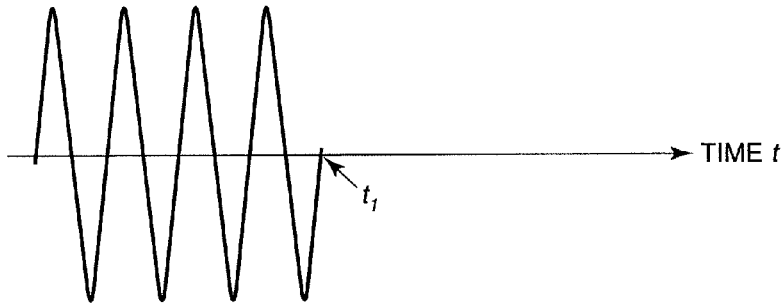
Figure 4C:
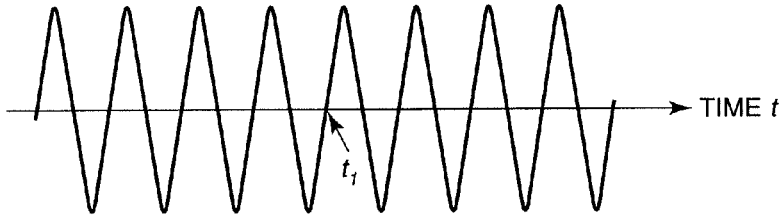
Figure 4D:
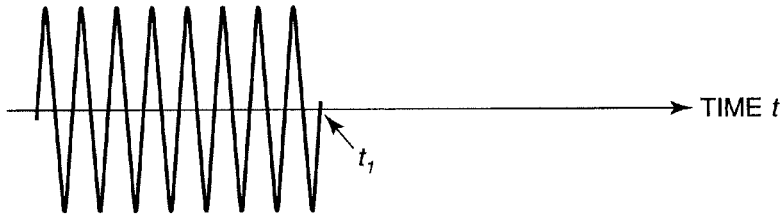

In the spark plug 50, the center electrode 51 is formed within the insulating member 53 formed from dielectric substance. It is therefore possible to suppress transition of the discharge between the insulating member 53 and the cylindrical electrode 52 from the non-equilibrium plasma discharge to the equilibrium plasma discharge even when the discharge energy of the center electrode 51 increases, Referring to FIGS. 4A-4D, the discharge energy of the non-equilibrium plasma discharge generated at the spark plug 50 varies according to the voltage value, the impression time period, and the frequency of the alternating current from the high-voltage/high-frequency alternate current generator 60. With respect to a reference waveform of the alternating current shown in FIG. 4A, an increase in the voltage value of the alternating current as shown in FIG. 4B, an increase in the impression time period of the alternating current as shown in FIG. 4C, or an increase in the frequency of the alternating current as shown in FIG. 4D, leads to an increase in the discharge energy of the spark plug 50.

Figure 5A:
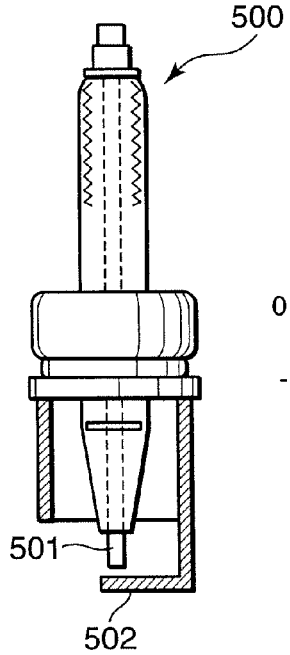
PRIOR ART FIG. 5A
FIGS. 5A and 5B are a side view, inclusive of a partial longitudinal sectional view, of a conventional spark plug, and a timing chart showing number of times that the non-equilibrium plasma discharge occurs.
Figure 5B:
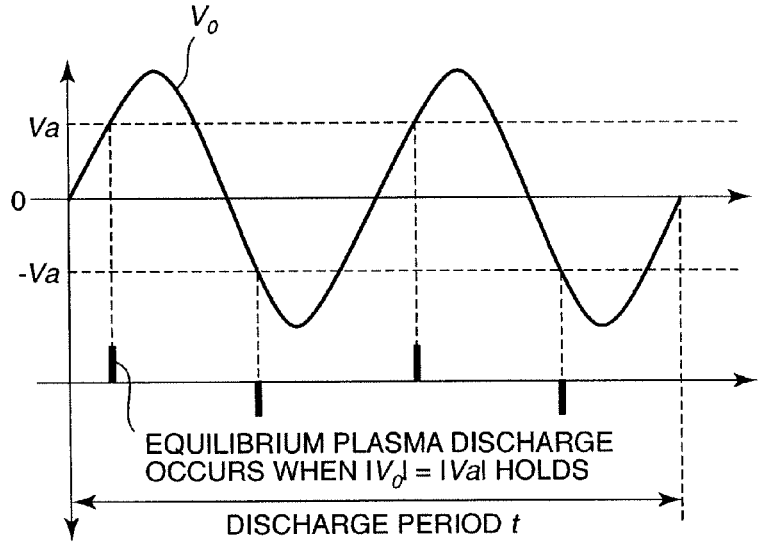
PRIOR ART FIG. 5B

FIGS. 5A and 5B show a conventional spark plug 500 that effects the equilibrium plasma discharge between an electrode 501 and an electrode 502, and a discharge timing thereof.

As shown in FIG. 5B, in the conventional spark plug 500, when the absolute value of an electric field V0 formed between the electrodes by impressed alternating current reaches a predetermined dielectric breakdown electric field Va, the equilibrium plasma discharge is effected between the electrodes 501 and 502. Thus, the conventional spark plug 500 effects the equilibrium plasma discharge four times during a given discharge period t.

Figure 6A:
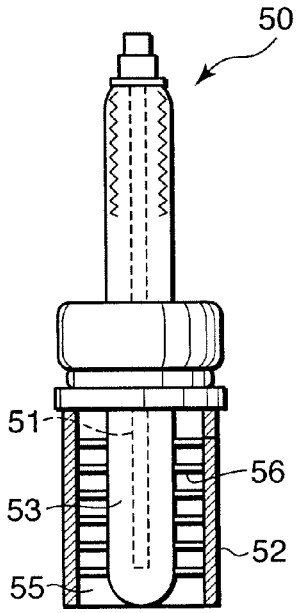
FIGS. 6A and 6B are a side view, inclusive of a partial longitudinal sectional view, of a spark plug according to this invention, and a timing chart showing number of times that the non-equilibrium plasma discharge occurs.
Figure 6B:
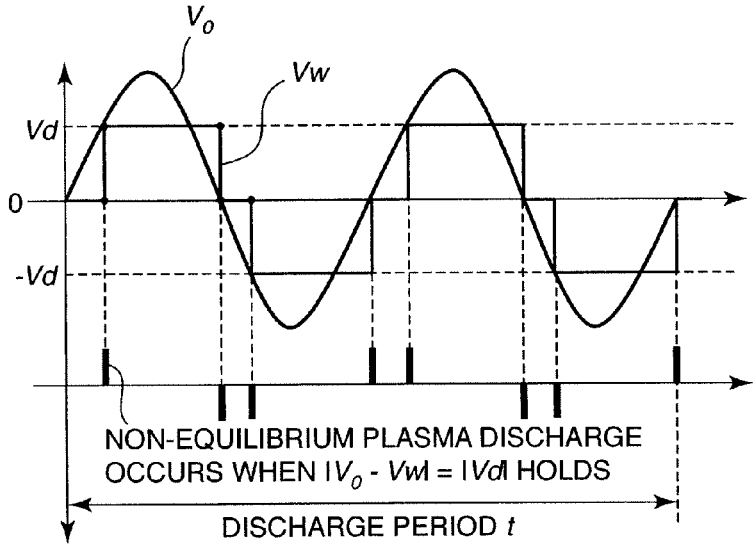

FIGS. 6A and 6B show the spark plug 50 of this invention, and a discharge timing thereof.

In the spark plug 50, the center electrode 51 is accommodated within the insulating member 53 formed from dielectric substance, and the insulating member 53 functions as a kind of capacitor. It is therefore possible to store electric charge in the surface of the insulating member 53 after the non-equilibrium plasma discharge. Thus, as shown in FIG. 6B, at the point in time when the absolute value of the difference between the electric field V0 according to the impressed alternating current and the electric field Vw according to the dielectric surface electric charge of the insulating member 53 reaches a predetermined non-equilibrium plasma discharge start electric field Vd, the non-equilibrium plasma discharge is effected between the insulating member 53 and the cylindrical electrode 52. Thus, the non-equilibrium plasma discharge is effected eight times during the discharge period t. Further, as shown in FIG. 6A, in the spark plug 50, streamers are formed in a large number of positions within the ignition chamber 55.

Not only does the spark plug 50 effects volumetric ignition on fuel mixture inside the ignition chamber 55, but it effects discharge a larger number of times during the same discharge period t as compared with the conventional spark plug 500. Thus, as compared with the conventional spark plug 500, which effects the equilibrium plasma discharge between the electrodes 501 and 502, the spark plug 50 according to this invention realizes a more powerful ignition performance.

By increasing the value of the voltage impressed thereto, the spark plug 50 can effect discharge a still larger number of times. More specifically, when, in FIG. 6B, the difference between the peak of the electric field V0 according to the impressed alternating current and the non-equilibrium plasma discharge start electric field Vw exceeds Vd, the number of times that the non-equilibrium plasma discharge occurs further increases within the same cycle.

The internal combustion engine 100 equipped with the spark plug 50 is operated based on the operation maps of which the contents are shown in FIGS. 7A-7D.

Figure 7A:
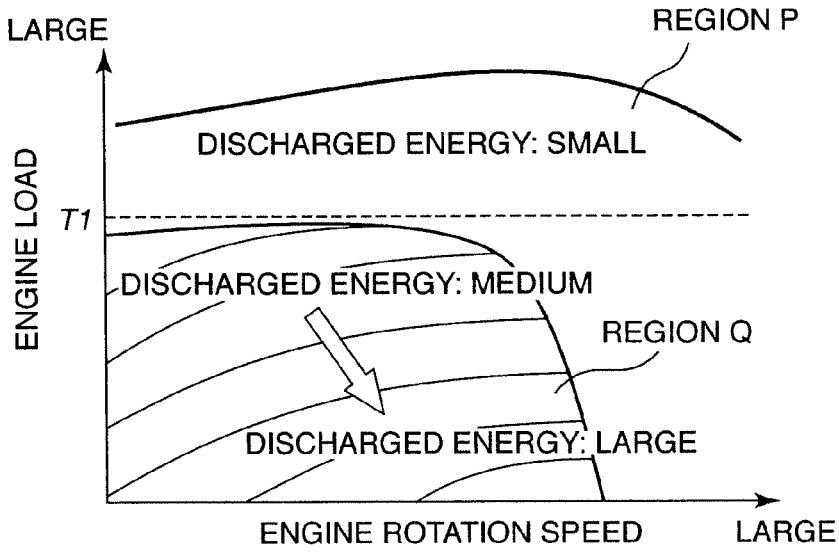
FIGS. 7A-7D are diagrams illustrating contents of maps of a discharged energy, an excess air factor, and an exhaust gas recirculation (EGR) rate of the internal combustion engine stored in a controller according to this invention.

Referring to FIG. 7A, the operation range for the internal combustion engine 100 is divided into a region P of high-rotation-speed/high-load and a region Q of low-rotation-speed/low-load.

Figure 7B:
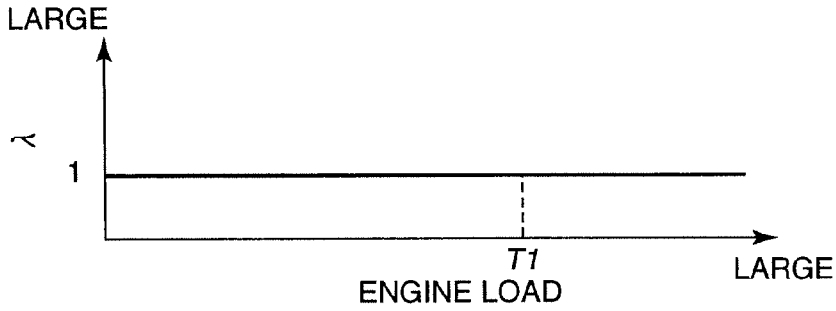

Referring to FIG. 7B, during operation in the region P, the internal combustion engine 100 is controlled such that the excess air factor λ is equal to 1, or in other words the fuel injection amount or the intake air volume of the internal combustion engine 100 is controlled such that the air-fuel ratio of the fuel mixture becomes equal to the stoichiometric air-fuel ratio.

In the region P, the controller 70 controls the high-voltage/high-frequency alternate current generator 60 such that the discharged energy is at a fixed level irrespective of the engine operation state. In the region P, the excess air factor λ is controlled to be equal to 1 such that the fuel mixture in the ignition chamber 55 has a composition which is easy to ignite. Thus, the discharged energy of the non-equilibrium plasma discharge of the spark plug 50 is set smaller than that during the operation under low-rotation-speed/low-load described below. However, it is possible to control the voltage value, the frequency, etc. of the impressed alternating current such that the discharged energy in the non-equilibrium plasma discharge increases as the rotation speed of the internal combustion engine 100 becomes higher and the engine load of the same becomes smaller within the region P.

Figure 7C:
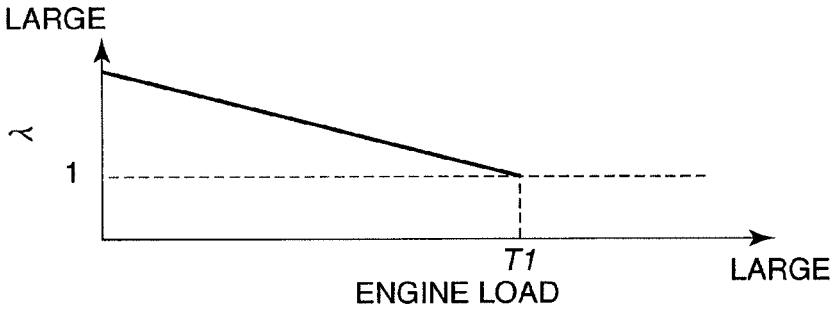

Referring to FIG. 7C, during operation in the region Q, the internal combustion engine 100 performs lean combustion while varying the excess air factor λ according to the engine load. Specifically, when the engine load is smaller than a predetermined value T1, the fuel injection amount or the intake air volume is controlled such that the excess air factor λ increases as the engine load decreases. As shown in FIG. 7A, the predetermined value T1 is determined from a maximum load in the region Q. In the lean combustion in the region Q, the ignition performance deteriorates if the same volumetric ignition is effected with the same discharged energy as in the region P.

Thus, in the region Q, the controller 70 sets the discharged energy of the non-equilibrium plasma discharge of the spark plug 50 greater than that in the region P. The controller 70 controls the voltage value, the wave number, etc. of the impressed alternating current in the region Q shown in FIG. 7A to increase the discharged energy of the non-equilibrium plasma discharge as the engine load becomes smaller and the engine rotation speed becomes higher, thereby stabilizing the ignition performance of the spark plug 50.

Figure 7D:
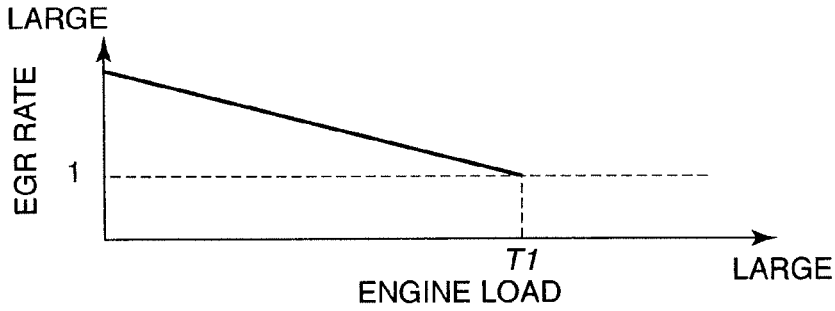

While the internal combustion engine 100 performs lean combustion during the operation under low-rotation-speed/low-load corresponding to the region Q, it is also possible to perform diluted combustion by recirculating a part of the exhaust gas to the intake port 30 by the EGR device. In this case, as shown in FIG. 7D, the EGR rate is controlled to increase as the engine load becomes smaller with respect to the predetermined value T1.

Control of the excess air factor λ and the EGR rate of the internal combustion engine 100 is performed by a control device supplied as a separate unit, but it is also possible to set up the controller 70 to control these factors.

In this way, the controller 70 sets the discharged energy of the non-equilibrium plasma of the spark plug 50 during the operation in the region Q of low rotation speed and low load larger than that during the operation in the region P of high rotation speed and high load. Further, also in the region Q, the controller 70 adjusts the voltage value, the wave number, etc. of the impressed alternating current such that the discharged energy of the non-equilibrium plasma discharge increases as the engine rotation speed increases at low load.

As described above, the spark plug 50 of the internal combustion engine 100 effects volumetric ignition in the ignition chamber 55, thereby forming a plurality of streamers 56 from the insulating member 53 toward the cylindrical electrode 52. Thus, even under a condition which is likely to lead to unstable combustion, such as lean combustion or diluted combustion, it is possible to achieve a sufficiently large heat generation. As a result, the ignition performance with respect to the fuel mixture in the combustion chamber 13 increases, and the combustion period for the fuel mixture can be shortened, making it possible to substantially expand the lean combustion limit. Further, by using the non-equilibrium plasma discharge, it is possible to ignite the fuel mixture with low energy consumption.

Since the insulating member 53 formed form dielectric substance covers the center electrode 51 in the spark plug 50, transition from the non-equilibrium plasma discharge to the equilibrium plasma discharge can be suppressed even when the discharged energy increases. Effecting ignition solely through the non-equilibrium plasma discharge without causing transition to the equilibrium plasma discharge is advantageous in that it makes it possible to suppress the energy consumed by the spark plug 50.

In the internal combustion engine 100, the voltage value, the wave number, etc. of the impressed alternating current are controlled such that the discharged energy of the spark plug 50 increases as the engine load decreases. Thus, it is possible to suppress fluctuations in the combustion performance under a low load, in which the combustion performance is rather unstable.

On the other hand, the voltage value, the wave number, etc. of the impressed alternating current are controlled such that the discharged energy of the spark plug 50 increases as the engine rotation speed increases. Thus, it is possible to achieve an improvement in terms of combustion speed under a high engine rotation speed, in which a required time for a unit crank angle rotation is short.

Further, the voltage value, the wave number, etc. of the impressed alternating current are controlled such that the discharged energy of the spark plug 50 increases as the air-fuel ratio becomes leaner, or as the EGR rate becomes higher. Thus, it is possible to enhance the ignition performance under an operating condition which leads to unstable combustion performance.

When the frequency of the impressed alternating current is increased to increase the wave number, the number of times that discharge is performed during a fixed time period is increased, resulting in an increase in the discharged energy. This setting is preferable in the case of a high engine rotation speed, at which the engine rotation period for a unit crank angle is short.

When the alternating current impression period is increased to increase the wave number, the non-equilibrium plasma discharge period increases, resulting in an increase in discharged energy. According to this setting, it is possible to enhance the ignition performance under a condition in which the fuel mixture density in the combustion chamber changes with passage of time, which is likely to cause ignition fluctuation, as in the case of diluted combustion, in which the fuel mixture density in the combustion chamber 13 is uneven.

Figure 8:
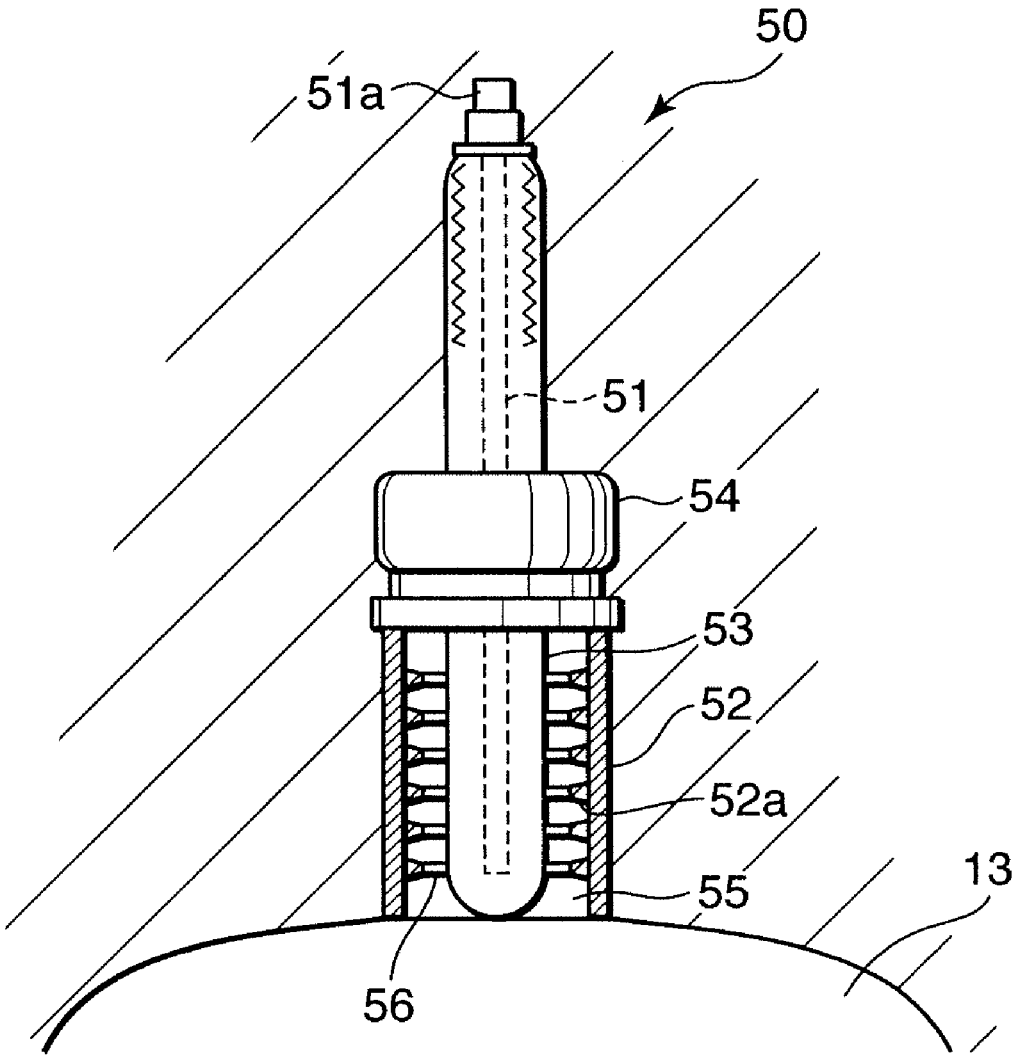
FIG. 8 is a side view, inclusive of a partial longitudinal sectional view, of a spark plug according to a second embodiment of this invention.

Referring to FIG. 8, a second embodiment of this invention will be described.

The ignition device according to this embodiment differs from that of the first embodiment in that a plurality of projections 52*a* are provided on the cylindrical electrode 52 of the spark plug 50. The other components of this ignition device are identical to those of the ignition device according to the first embodiment of this invention.

The spark plug 50 is provided with a plurality of projections 52*a* arranged in the axial and radial directions on the inner peripheral surface of the cylindrical electrode 52 to protrude into the ignition chamber 55. The projections 52*a* are formed of a conductive material, and the distal ends of all the projections 52*a* are at a same distance from the insulating member 53.

In the spark plug 50, the non-equilibrium plasma discharge is effected between the projections 52*a* of the cylindrical electrode 52 and the insulating member 53. The number of streamers 56 formed in the ignition chamber 55 is identical to the number of the projections 52*a*.

The ignition device according to the second embodiment of this invention provides the same effects as those of the first embodiment. Further, since it can generate the equilibrium plasma discharge at required positions arbitrarily in the ignition chamber 55, the ignition performance is further enhanced.

When a gap required for effecting non-equilibrium plasma discharge is small, since the distance between the cylindrical electrode 52 and the surface of the insulating member 53 can be set arbitrarily within a wide range through adjustment of the distance between the projections 52*a* and the insulating member 53, the heat loss of the initial flame can be suppressed to be small.

Instead of providing the cylindrical electrode 52 with a plurality of projections 52*a*, it is also possible to provide the insulating member 53, which covers the center electrode 51, with a plurality of projections formed from dielectric material.

Figure 9:
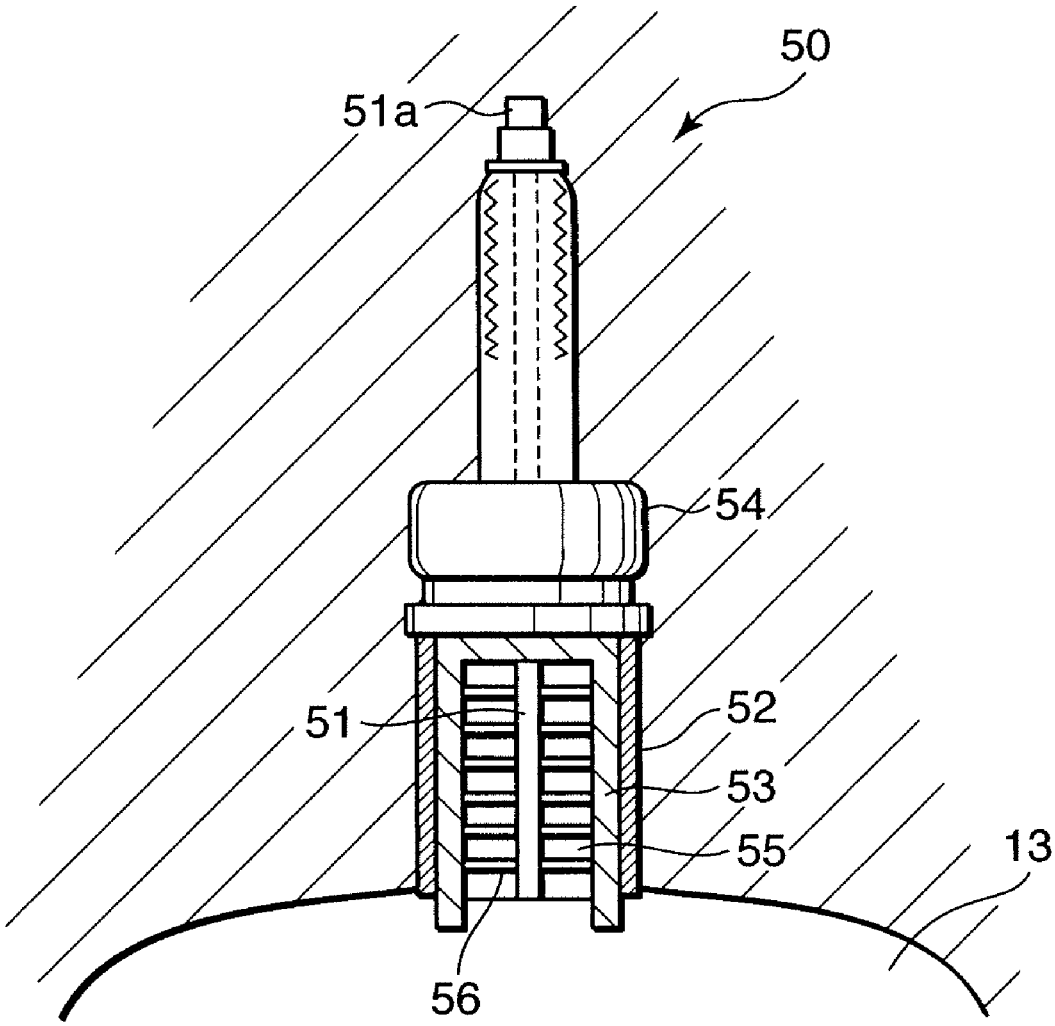
FIG. 9 is similar to FIG. 6 but shows a third embodiment of this invention.

Referring to FIG. 9, a third embodiment of this invention will be described.

In the ignition device according to this embodiment, the insulating member 53 of the spark plug 50 is in contact with the inner periphery of the cylindrical electrode 52, and covers the cylindrical electrode 52. In other words, the insulating member 53 covers not the first electrode but the second electrode. The other components of this ignition device are identical to those of the ignition device according to the first embodiment.

The insulating member 53 is formed into a cylindrical shape having a bottom. The insulating member 53 is fitted into the inner peripheral surface of the cylindrical electrode 52. The lower end of the insulating member 53 extends lower than the lower end of the cylindrical electrode 52 and protrudes into the combustion chamber 13. The space between the bar-like center electrode 51 and the insulating member 53 functions as the ignition chamber 55. The ignition chamber 55 communicates with the combustion chamber 13 via an opening directed to the combustion chamber 13.

In the spark plug 50, the non-equilibrium plasma discharge occurs between the center electrode 51 and the insulating member 53, forming a plurality of streamers 56 arranged axially and radially. Thus, in this embodiment also, it is possible to effect volumetric ignition on the fuel mixture in the ignition chamber 55.

Further, since the lower end of the insulating member 53 protrudes downwards beyond the lower end of the cylindrical electrode 52, it is possible to suppress the generation of the equilibrium plasma discharge between the forward end of the center electrode 51 and the forward end of the cylindrical electrode 52 even when the discharged energy of the non-equilibrium plasma discharge is increased.

In this embodiment also, preferable effects as those of the first embodiment are obtained.

Figure 10:
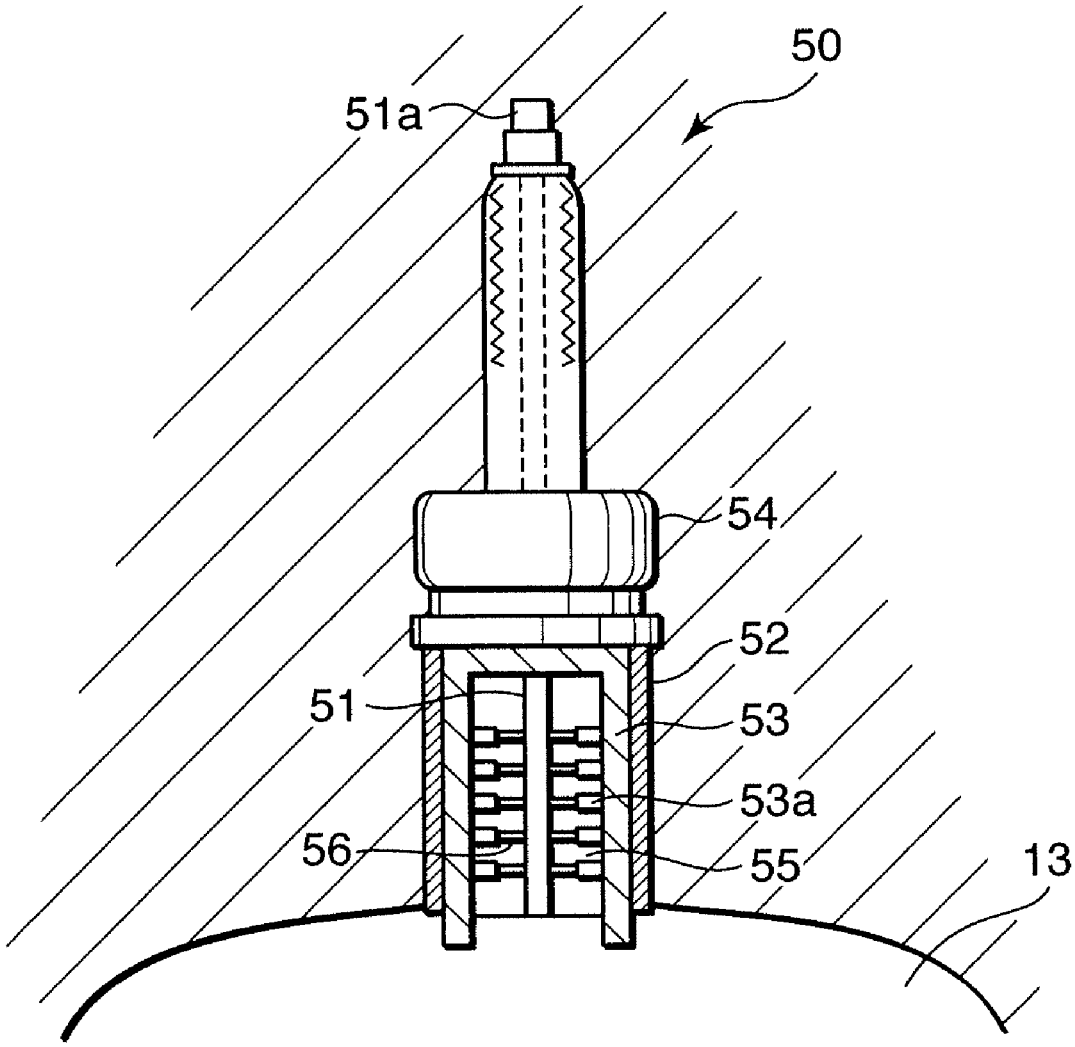
FIG. 10 is similar to FIG. 6 but shows a fourth embodiment of this invention.

Referring to FIG. 10, a fourth embodiment of this invention will be described.

In the ignition device according to this embodiment, a plurality of projections 53*a* protruding into the ignition chamber 55 are arranged axially and radially on the inner periphery of the insulating member 53 of the third embodiment of this invention. The other components of this ignition device are identical to those of the ignition device according to the third embodiment.

The plurality of projections 53*a* are formed from dielectric material, and the distance between the distal ends of the projections 53*a* and the center electrode 51 is set to be constant.

In this embodiment, the non-equilibrium plasma discharge occurs between the projections 53*a* of the insulating member 53 and the center electrode 51. The number of the streamers 56 formed in the ignition chamber 13 is identical to that of the projections 53*a*.

The ignition device according to this embodiment brings about the same effect as that of the third embodiment. Further, since it can generate the equilibrium plasma discharge at required positions arbitrarily in the ignition chamber 55, it is possible to attain a still higher ignition performance.

Since the distance between the projections 53*a* and the center electrode 51 can be set arbitrarily, the distance between the inner peripheral surface of the insulating member 53 and the center electrode 51 can be set large even when the gap required for the non-equilibrium plasma discharge is small, thereby suppressing the heat loss of the initial flame.

Instead of providing the projections 53*a* on the insulating member 53, it is also possible to provide a plurality of projections on the center electrode 51.

Figure 11:
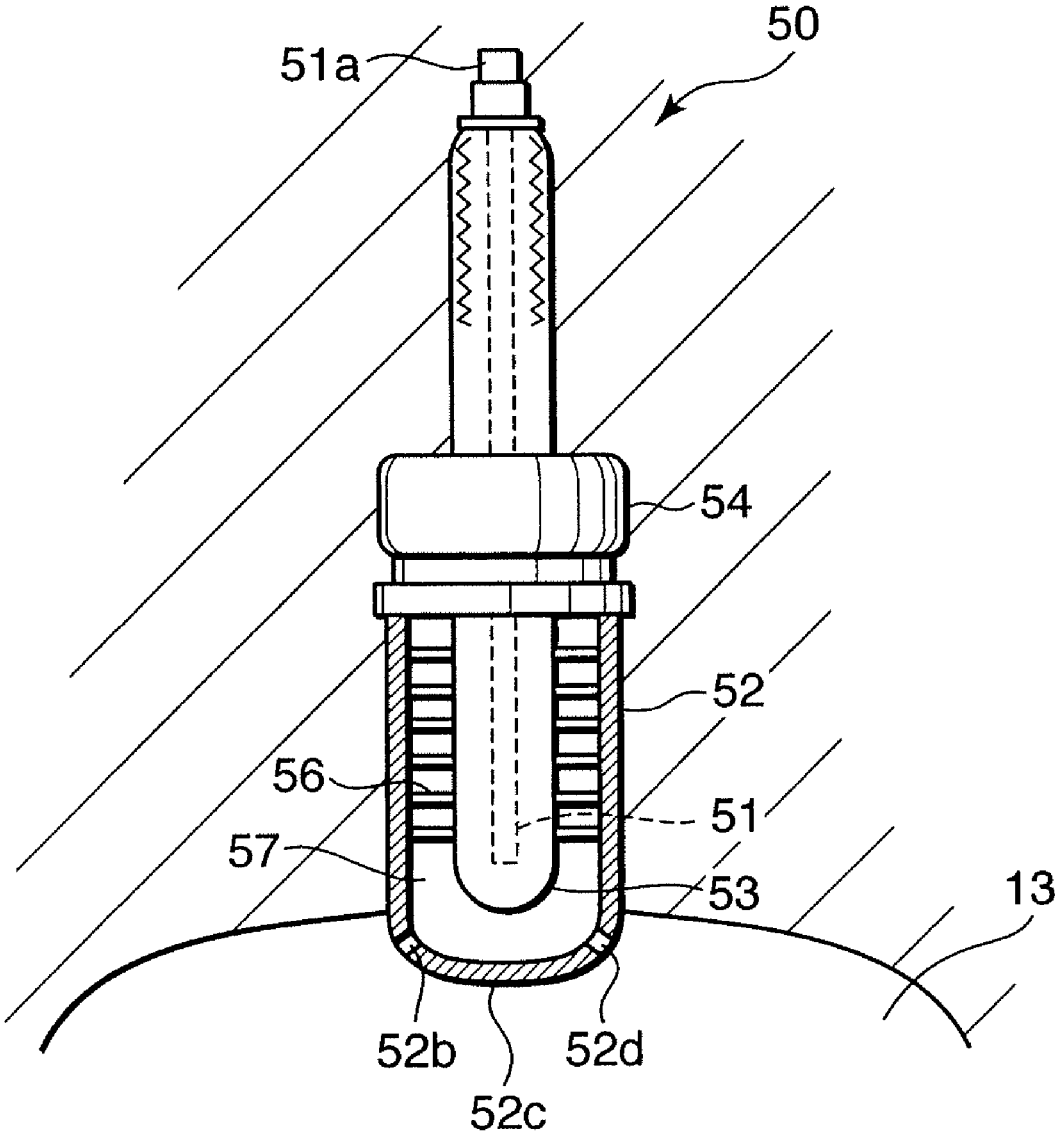
FIG. 11 is similar to FIG. 6 but shows a fifth embodiment of this invention.

Referring to FIG. 11, a fifth embodiment of this invention will be described.

In the ignition device according to the first embodiment of this invention, the lower end of the cylindrical electrode 52 is open to the combustion chamber 13. In this embodiment, in contrast, the cylindrical electrode 52 is formed to have a closed lower end 52*c* protruding toward the combustion chamber 13. An auxiliary combustion chamber 57 is defined between the lower end 52*c* and the insulating member 53. At the lower end 52*c*, a plurality of communication holes 52*b* for establishing communication between the combustion chamber 13 and the auxiliary combustion chamber 57 are provided. The other components of this ignition device are identical to those of the ignition device according to the first embodiment.

In this embodiment, a portion of the fuel mixture aspirated into the combustion chamber 13 flows into the auxiliary combustion chamber 57 via the communication holes 52*b*. Immediately before the piston 11 reaches the compression top dead center, the fuel mixture which has flowed into the auxiliary combustion chamber 57 undergoes volumetric ignition by the non-equilibrium plasma discharge generated between the cylindrical electrode 52 and the insulating member 53 of the spark plug 50. The combustion gas generated in the auxiliary combustion chamber 57 is radiated in a torch-like fashion into the combustion chamber 13 via the communication holes 52*b*, igniting the fuel mixture in the combustion chamber. In the following description, this mode of ignition will be referred to as torch ignition.

In this embodiment, volumetric ignition is effected on the fuel mixture in the auxiliary combustion chamber 57, and hence this embodiment brings about preferable effects as those of the first embodiment of this invention. Further, since torch ignition is effected on the fuel mixture in the combustion chamber 13 by using the combustion gas generated in the auxiliary combustion chamber 57, the combustion of the fuel mixture in the combustion chamber 13 is further promoted. As a result the lean burn limit can be expanded with respect to the case of the first embodiment.

Referring to FIG. 12, FIGS. 13A and 13B, FIGS. 14-16, FIGS. 17A-17C, and FIGS. 18A-18C a sixth embodiment of this invention will be described.

Figure 12:
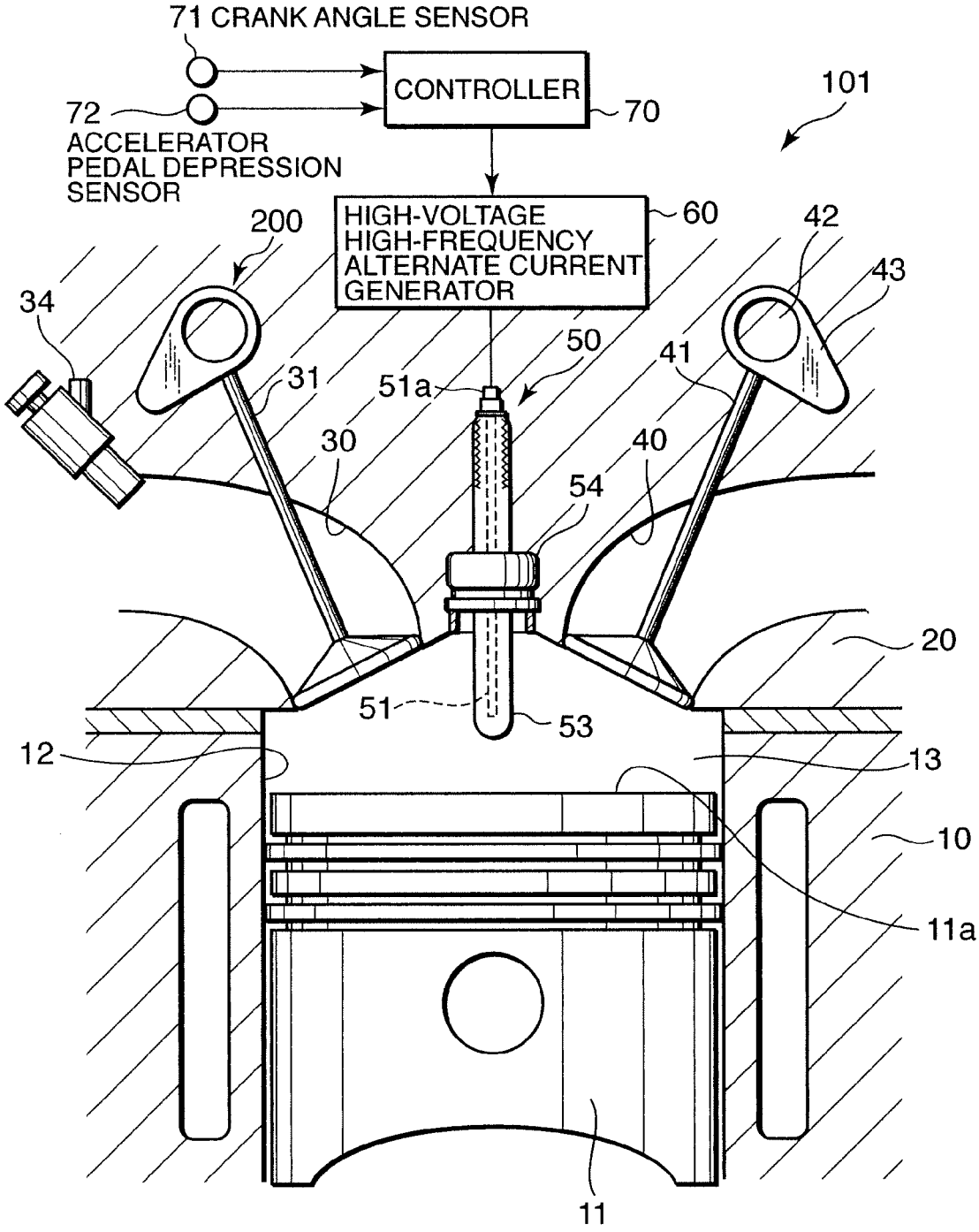
FIG. 12 is an enlarged schematic longitudinal sectional view of essential parts of an internal combustion engine, illustrating the construction of an ignition device according to a sixth embodiment of this invention.

Referring to FIG. 12, in the ignition device according to this embodiment, the center electrode 51 and the insulating member 53 of the first embodiment are caused to protrude into the combustion chamber 13. In this embodiment, the wall surface of the cylinder head 20 and the crown surface 11*a* of the piston 11 constitute the second electrode.

Figure 13A:
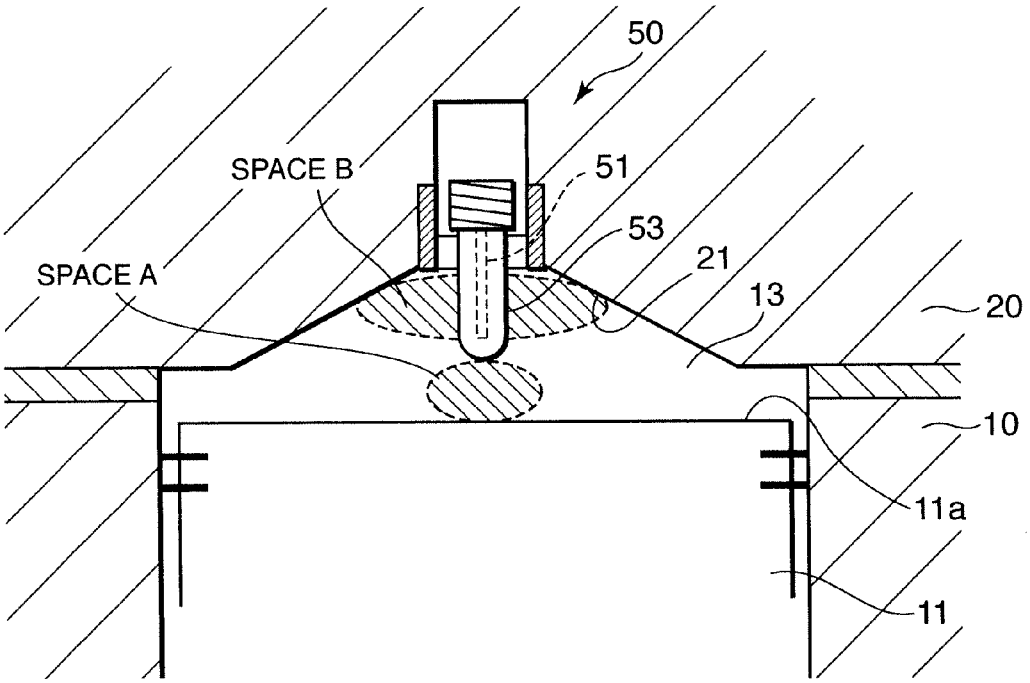
FIGS. 13A and 13B are schematic longitudinal sectional views of essential parts of the internal combustion engine, illustrating how the ignition device according to the sixth embodiment of this invention causes the non-equilibrium plasma discharge.

Referring to FIG. 13A, the spark plug 50 causes the non-equilibrium plasma discharge within the combustion chamber 13 to effect volumetric ignition on the fuel mixture in the combustion chamber 13. The spark plug 50 effects the non-equilibrium plasma discharge at least in one of the two spaces, a space A between the insulating member 53 and the crown surface 11*a* of the piston 11, and a space B between the insulating member 53 and the wall surface 21 of the cylinder head 20 covering the combustion chamber 13. Through the non-equilibrium plasma discharge, volumetric ignition is effected on the fuel mixture inside the combustion chamber 13.

Whether the non-equilibrium plasma discharge is to be effected in the space A or the non-equilibrium plasma discharge is to be effected in the space B is determined by the position of the piston when the alternating current is impressed to the spark plug 50. By controlling the timing at which the alternating current is impressed to the spark plug 50 in relation to the stroke position of the piston 11, it is possible to select the discharge space for the non-equilibrium plasma discharge.

Figure 13B:
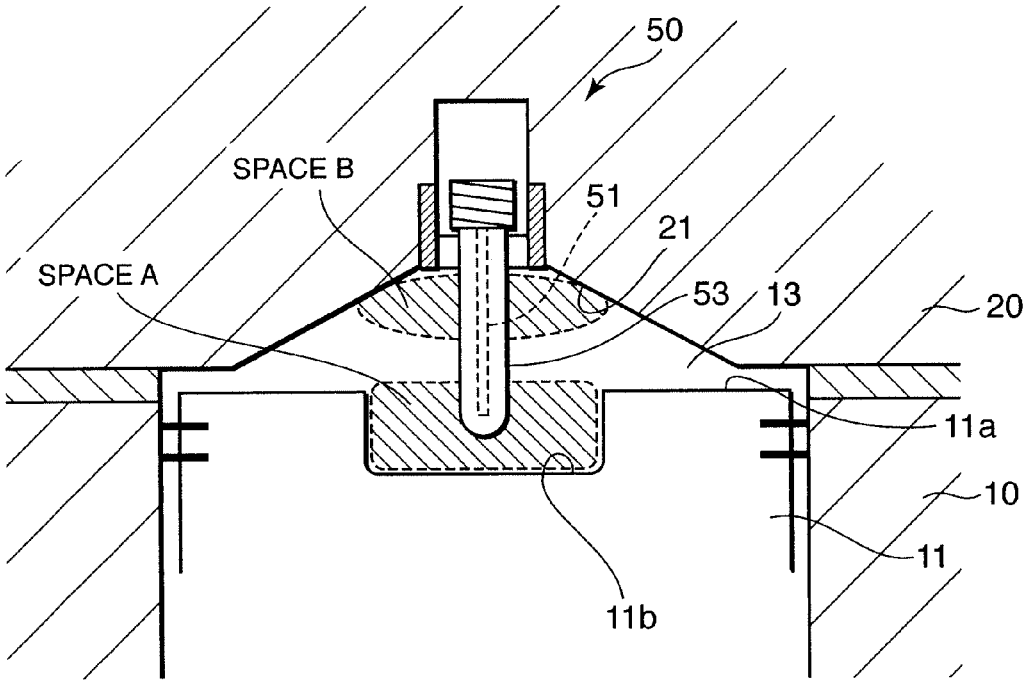

Referring to FIG. 13B, it is also possible to provide a recess 11*b* in the piston 11, and to cause the forward end of the insulating member 53 of the spark plug 50 to effect the non-equilibrium plasma discharge within the recess 11*b*.

The ignition device according to this embodiment is applied to an internal combustion engine 101 equipped with a variable valve mechanism 200, which makes the valve characteristics such as the lift amount and operation angle of the intake valve 31 variable.

The internal combustion engine 101 is a four-stroke-cycle multi-cylinder engine and executes Miller-cycle engine operation according to the engine operating state.

Figure 14:
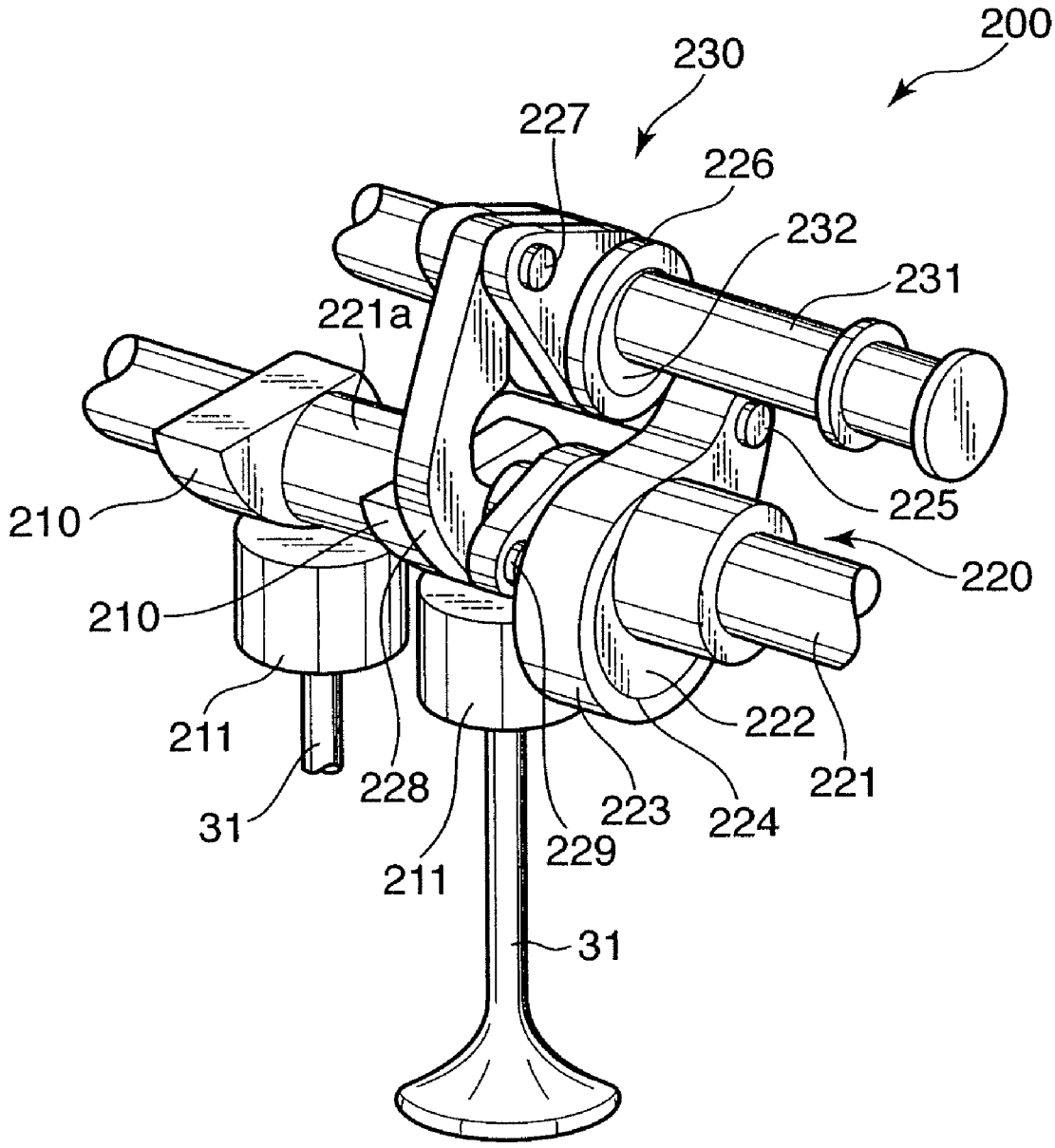
FIG. 14 is a perspective view of a variable valve mechanism provided in the internal combustion engine to which the ignition device according to the sixth embodiment of this invention is applied.
Figure 15:
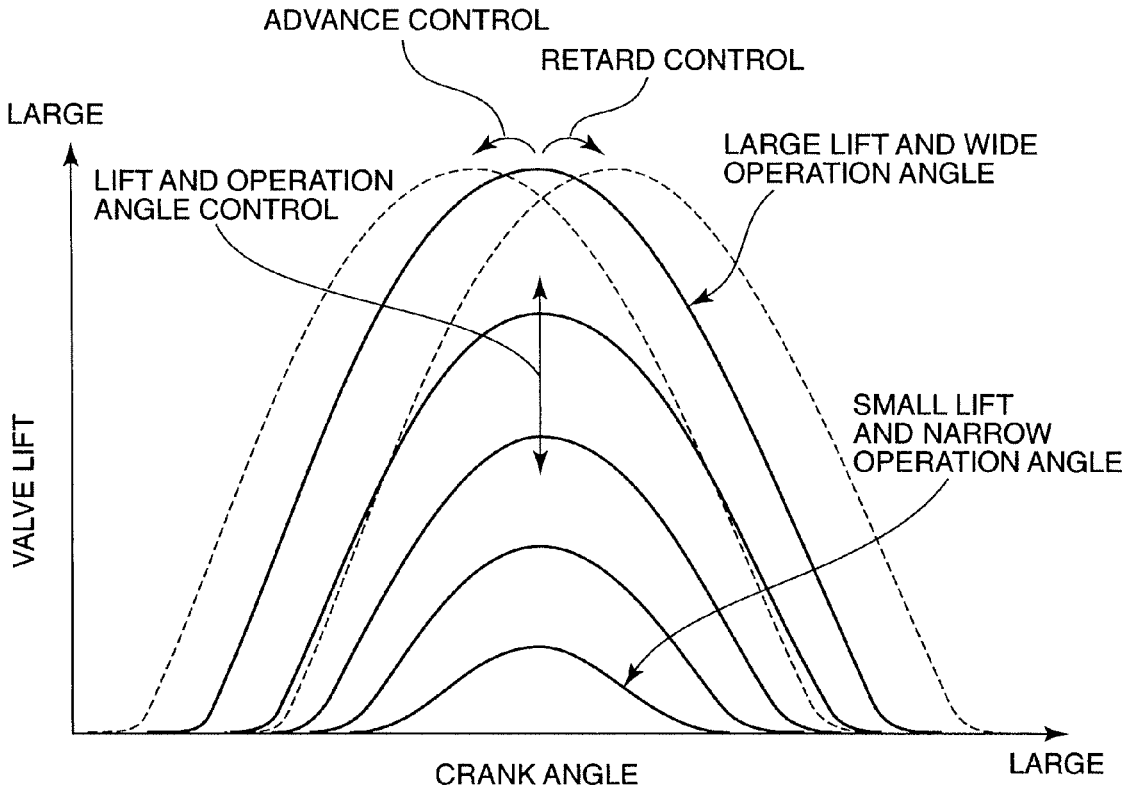
FIG. 15 is a diagram illustrating changes in valve lift of an intake valve according to the variable valve mechanism.

Referring to FIGS. 14 and 15, the variable valve mechanism 200 will be described.

In the non-equilibrium plasma discharge type internal combustion engine 101, each of the cylinders is equipped with two intake ports 30 and two intake valves 31. The two intake valves 31 are opened and closed in synchronism with each other by a single variable valve mechanism 200.

Referring to FIG. 14, the variable valve mechanism 200 comprises two oscillating cams 210, an oscillating cam driving mechanism 220 for oscillating the oscillating cams 210, and a lift amount varying mechanism 230 capable of continuously changing the lift amounts of the two intake valves 31.

The oscillating cams 210 are fitted onto the outer periphery of a drive shaft 221 extending in the cylinder row direction of the internal combustion engine 101, so as to be free to rotate. The oscillating cams 210 open and close the intake valves 31 via valve lifters 211. The two oscillating cams 210 are connected in the same phase via a connecting cylinder 221*a* which is supported on the outer periphery of the drive shaft 221 so as to be free to rotate. The two oscillating cams 210 operate in synchronism with each other.

An eccentric cam 222 is fixed to the drive shaft 221 by press-fitting or the like. The eccentric cam 222 has a circular outer peripheral surface, and the center of its outer peripheral surface is offset from the axis of the drive shaft 221 by a predetermined amount. When the drive shaft 221 rotates together with the crankshaft, the eccentric cam 222 rotates eccentrically around the axis of the drive shaft 21. An annular section 224 at a base end of a first link 223 is fitted onto the outer peripheral surface of the eccentric cam 222 so as top be free to rotate.

A lift amount varying mechanism 230 comprises a control shaft 231 and a rocker arm 226. The rocker arm 226 is supported on the outer periphery of an eccentric cam 232 formed on the control shaft 231, so as to be free to oscillate. The rocker arm 226 have two ends extending radially.

A tip end of the first link 223 is connected to one end of the rocker arm 226 via a connecting pin 225. An upper end of a second link 228 is connected to the other end of the rocker arm 226 via a connecting pin 227. A lower end of the second link 228 is connected via a connecting pin 229 to the oscillating cams 210 for driving the intake valves 31.

When the drive shaft 221 rotates in synchronism with the engine rotation, the eccentric cam 222 makes eccentric rotation, whereby the first link 223 oscillates vertically. Through the oscillation of the first link 223, the rocker arm 226 oscillates around the axis of the eccentric cam 232, the second link 228 oscillates vertically, and the two oscillating cams 210 are oscillated within a predetermined rotation angle range via the connecting cylinder 221*a*. Through the synchronous oscillation of the two oscillating cams 210, the two intake valves 31 open and close the intake ports 30 synchronously.

A cam sprocket which is rotated by the crankshaft is connected to one end of the drive shaft 221. The drive shaft 221 and the cam sprocket are constructed so as to allow adjustment of the phase in their rotating direction. By changing the phase in the rotating direction of the drive shaft 221 and the cam sprocket, it is possible to adjust the phase in the rotating direction of the crankshaft and the drive shaft 221.

One end of the control shaft 231 is connected to a rotary actuator via a gear or the like. By changing the rotation angle of the control shaft 231 by the rotary actuator, the axis of the eccentric cam 232 constituting the oscillation center of the rocker arm 226 swings around the rotation center of the control shaft 231, with the result that the fulcrum of the rocker arm 226 is displaced. As a result, the attitudes of the first link 223 and the second link 228 are changed, and the distance between the oscillation center of the oscillating cams 210 and the rotation center of the rocker arm 226 changes, resulting in a change in the oscillation characteristics of the oscillating cams 210.

Referring to FIG. 15, the valve characteristics of the intake valves 31 driven by the variable valve mechanism 200, or in other words the relationship between the lift amount and the operation angle, will be described. The solid lines in the drawing indicate changes in the lift amount of the intake valves 31 when the rotation angle of the control shaft 231 is varied, and the broken lines in the drawing indicate changes in the lift positions of the intake valves 31 when the phase in the rotating direction of the drive shaft 221 and the cam sprocket is varied. In the variable valve mechanism 200, by changing the rotation angle of the control shaft 231 and the phase in the rotating direction of the drive shaft 221 with respect to the cam sprocket, it is possible to continuously change the valve characteristics of the intake valves 31 such as the lift amount and the operation angle thereof.

The other components of this internal combustion engine 101 are identical to those of the internal combustion engine 100 described with reference to the first embodiment.

In the internal combustion engine 101, the variable valve mechanism 200 opens and closes the intake valves 31, whereby the valve characteristics are changed at the time of low-rotation-speed/low-load operation to execute Miller-cycle engine operation.

Figure 16:
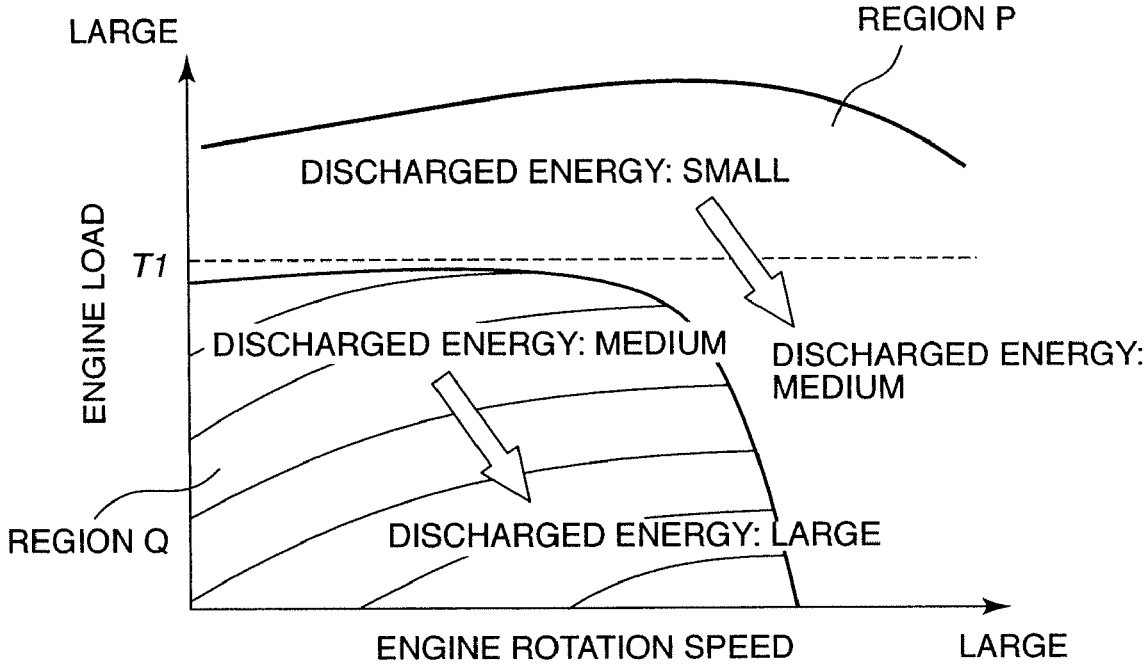
FIG. 16 is a diagram illustrating a discharged energy map stored in a controller according to the sixth embodiment of this invention.

Referring to FIGS. 16-18 next, the operation state of the internal combustion engine 101 will be described.

Referring to FIG. 16, the operation range for the internal combustion engine 101 can be divided into a region P where high-rotation-speed/high-load operation is performed and a region Q where low-rotation-speed/low-load operation is performed.

Figure 17A:
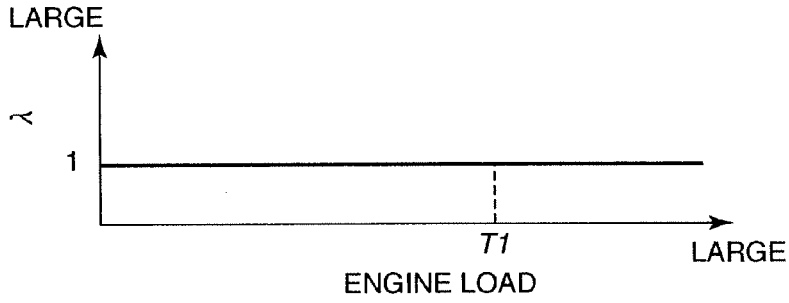
FIGS. 17A-17C are diagrams illustrating the excess air factor, the EGR rate, and the intake valve close (IVC) timing in an operation range of high-engine-rotation-speed/high-engine-load in the internal combustion engine equipped with the ignition device according to the sixth embodiment of this invention.

Referring to FIG. 17A, in the region P, the fuel injection amount of the internal combustion engine 101 is controlled such that the excess air factor $\lambda$ is equal to 1.0, or in other words the air-fuel ratio is equal to the stoichiometric air-fuel ratio, irrespective of the engine operation state.

Figure 17B:
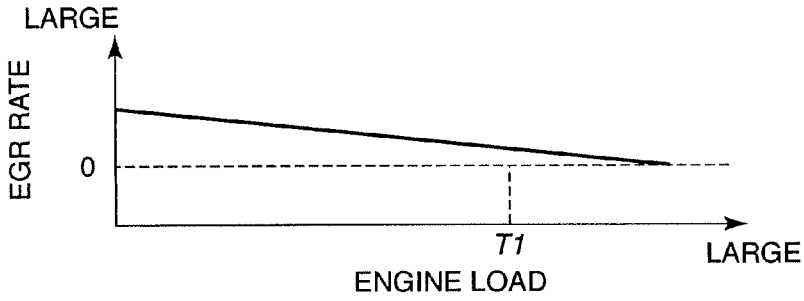

Referring to FIG. 17B, in the region P, the EGR rate is controlled according to the engine load, and the internal combustion engine 101 performs diluted combustion. The EGR rate is set to decrease as the engine load increases.

In the region P, the internal combustion engine 101 performs no Miller-cycle engine operation.

Figure 17C:
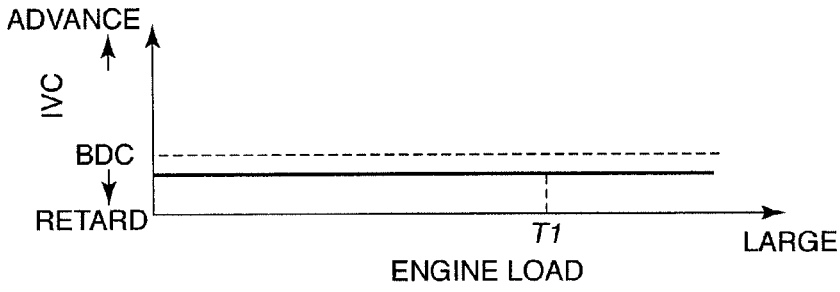

Referring to FIG. 17C, in the region P, the intake valve close (IVC) timing of the intake valves 31 is set so as to be retarded with respect to the piston bottom dead center.

If diluted combustion with EGR is also effected in the region P, where high-rotation-speed/high-load operation is conducted, the ignition performance for the fuel mixture deteriorates. As shown in FIG. 16, in the region P, as the load decreases and the engine rotation speed increases, the controller 70 adjusts the voltage value, the wave number, etc. of the impressed alternating current so as to increase the discharged energy in the non-equilibrium plasma discharge, thereby stabilizing the ignition performance. However, the discharged energy in the non-equilibrium plasma discharge of the spark plug 50 in the region P is set smaller than that in the region Q, where low-rotation-speed/low-load operation is conducted.

Figure 18A:
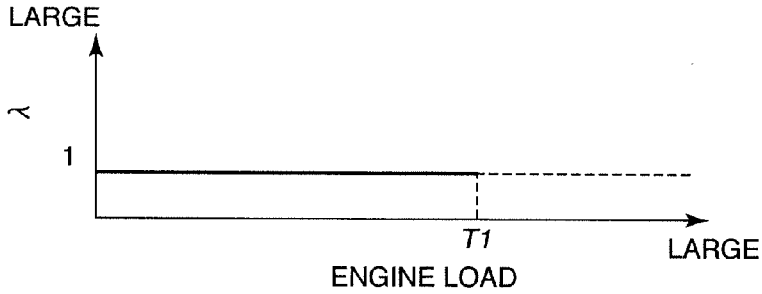
FIGS. 18A-18C are diagrams illustrating the excess air factor, the EGR rate, and the IVC timing in an operation range of low-engine-rotation-speed/low-engine-load in the internal combustion engine equipped with the ignition device according to the sixth embodiment of this invention.

Referring to FIG. 18A, in the region Q, the fuel injection amount of the internal combustion engine 101 is controlled such that the excess air factor $\lambda$ is equal to 1.0, or in other words the air-fuel ratio is equal to the stoichiometric air-fuel ratio, independently of the engine operation state.

Figure 18B:
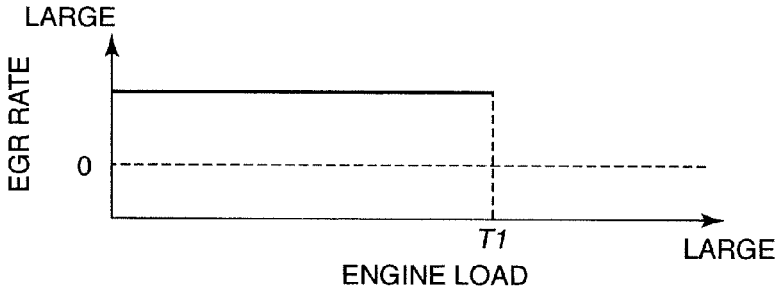

Referring to FIG. 18B, in the region Q, the EGR rate is maintained at a fixed level, and the internal combustion engine 101 performs diluted combustion.

Figure 18C:
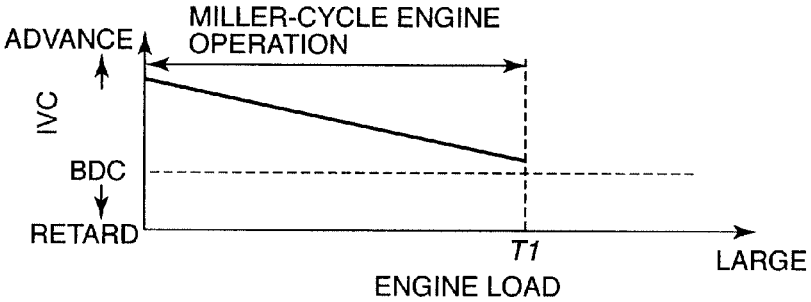

Referring to FIG. 18C, in the region Q, the internal combustion engine 101 performs Miller-cycle engine operation.

In Miller-cycle engine operation, the IVC timing is advanced with respect to the piston bottom dead center, and the intake of fuel mixture is stopped during the intake stroke. The advancement amount of the IVC timing of the intake valves 31 is adjusted so as to become larger as the load decreases, causing the intake valves 31 to be closed at an early stage. Due to Miller-cycle engine operation, the pump loss is reduced even under low load, making it possible to reduce the fuel consumption.

Control of the excess air factor λ, the EGR rate, or the IVC timing of the internal combustion engine 101 is conducted by a control device provided as a separate unit, but it is also possible to set up the controller 70 to control these factors.

When Miller-cycle engine operation and diluted combustion are effected in the region Q, the ignition performance for the fuel mixture deteriorates. To remedy this deterioration, the controller 70 sets the discharged energy of the non-equilibrium plasma discharge of the spark plug 50 larger than that in the region P, where high-rotation-speed/high-load operation is performed. By thus increasing the discharged energy of the spark plug 50, which effects volumetric ignition on the fuel mixture in the combustion chamber 13, the ignition performance of the internal combustion engine 101 is stabilized.

In the ignition device according to this embodiment, the non-equilibrium plasma discharge is effected between the insulating member 53 of the spark plug 50 and the conductor within the combustion chamber 13 such as the crown surface 11*a* of the piston 11 or the wall surface 21 of the cylinder head 20, thereby effecting volumetric ignition on the fuel mixture in the combustion chamber 13. Since the non-equilibrium plasma discharge is effected in the large space within the combustion chamber 13, it is possible to increase the discharge volume as compared with that of the ignition device of the first embodiment. Thus, even under a condition likely to lead to unstable combustion, as in the case of lean combustion or diluted combustion, it is possible to improve the ignition performance and shorten the combustion period, so it is possible to substantially expand the lean burn limit.

Further, during Miller-cycle engine operation, the voltage value, the wave number, etc. of the impressed alternating current are controlled such that the discharged energy of the equilibrium plasma discharge increases as the advancement amount of the closing timing for the intake valves 31 increases, thereby stabilizing the ignition performance.

Referring to FIG. 19, FIGS. 20A and 20B, FIG. 21, FIGS. 22A-22C, and FIGS. 23A-23C, a seventh embodiment of this invention will be described.

Figure 19:
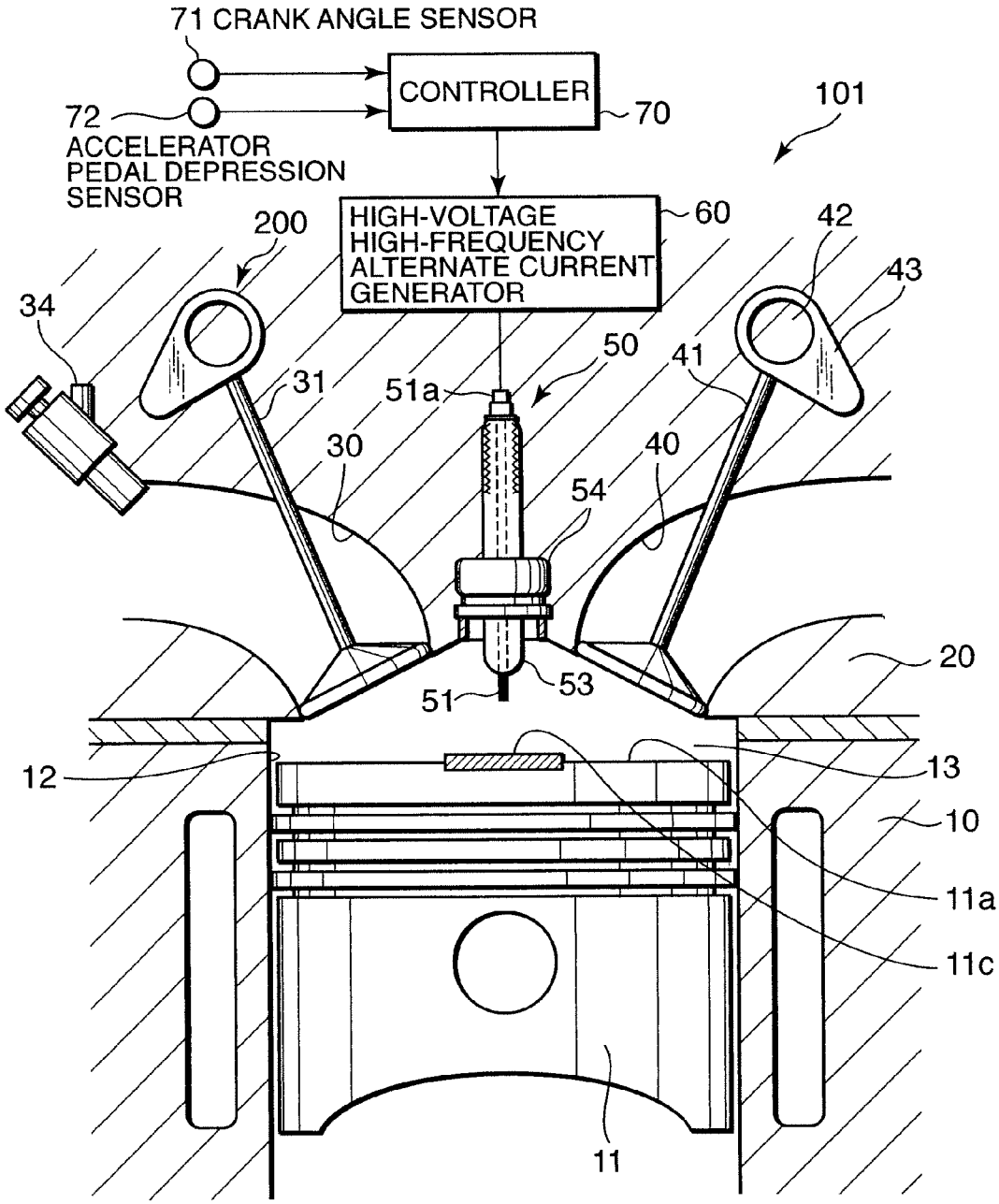
FIG. 19 is an enlarged schematic longitudinal sectional view of essential parts of an internal combustion engine, illustrating the construction of an ignition device according to a seventh embodiment of this invention.

Referring to FIG. 19, in the ignition device according to this embodiment, the center electrode 51 and the insulating member 53 of the spark plug 50 protrude into the combustion chamber 13 as in the case of the sixth embodiment. In the ignition device according to this embodiment, a part of the center electrode 51 further protrudes into an inner side of the combustion chamber 13 beyond the insulating member 53. A part of the crown surface 11*a* of the piston 11 facing the center electrode 51 is covered with an insulating member 11*c* formed from dielectric material. In the ignition device according to this embodiment, the crown surface 11*a* of the piston 11 constitutes the second electrode.

Figure 20A:
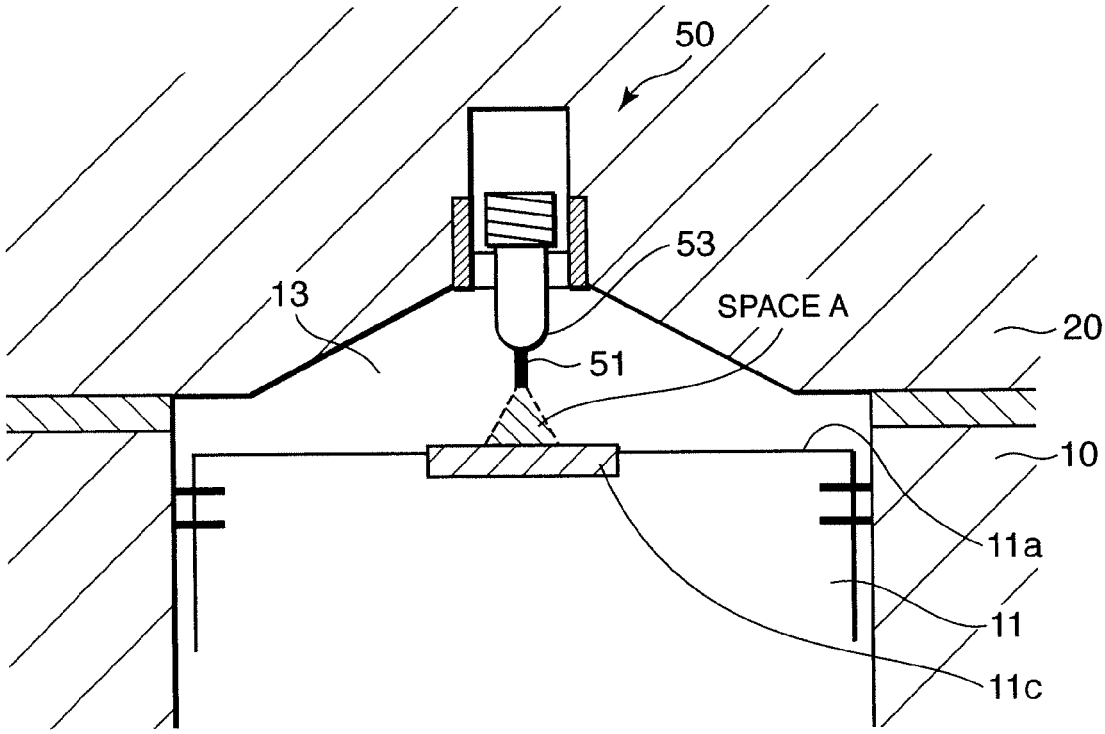
FIGS. 20A and 20B are schematic longitudinal sectional views of essential parts of the internal combustion engine, illustrating how the ignition device according to the seventh embodiment of this invention effects the non-equilibrium plasma discharge.

Referring to FIG. 20A, the ignition device of this embodiment effects the non-equilibrium plasma discharge in the space A between the forward end of the center electrode 51 protruding into the inner side of the combustion chamber 13 from the insulating member 53 and the insulating member 11*c* covering the crown surface 11*a* of the piston 11, effecting volumetric ignition on the fuel mixture in the combustion chamber 13.

Figure 20B:
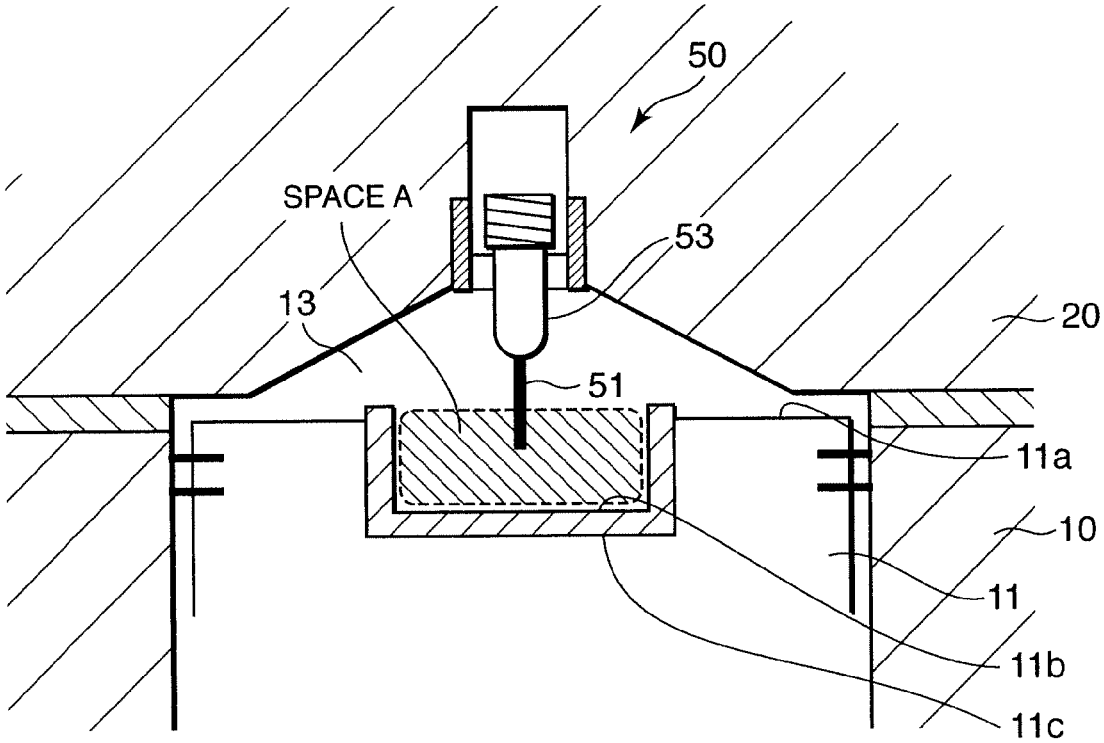

Referring to FIG. 20B, it is also possible to provide the piston 11 with a recess 11*b* covered with the insulating member 11*c* formed from dielectric material. In this case, the non-equilibrium plasma discharge is effected in the recess 11*b* between the center electrode 51 protruding into the combustion chamber 13 from the insulating member 53 and the insulating member 11*c*.

The other components of the internal combustion engine 101 are identical to those of the internal combustion engine 101 described with reference to the sixth embodiment.

Figure 21:
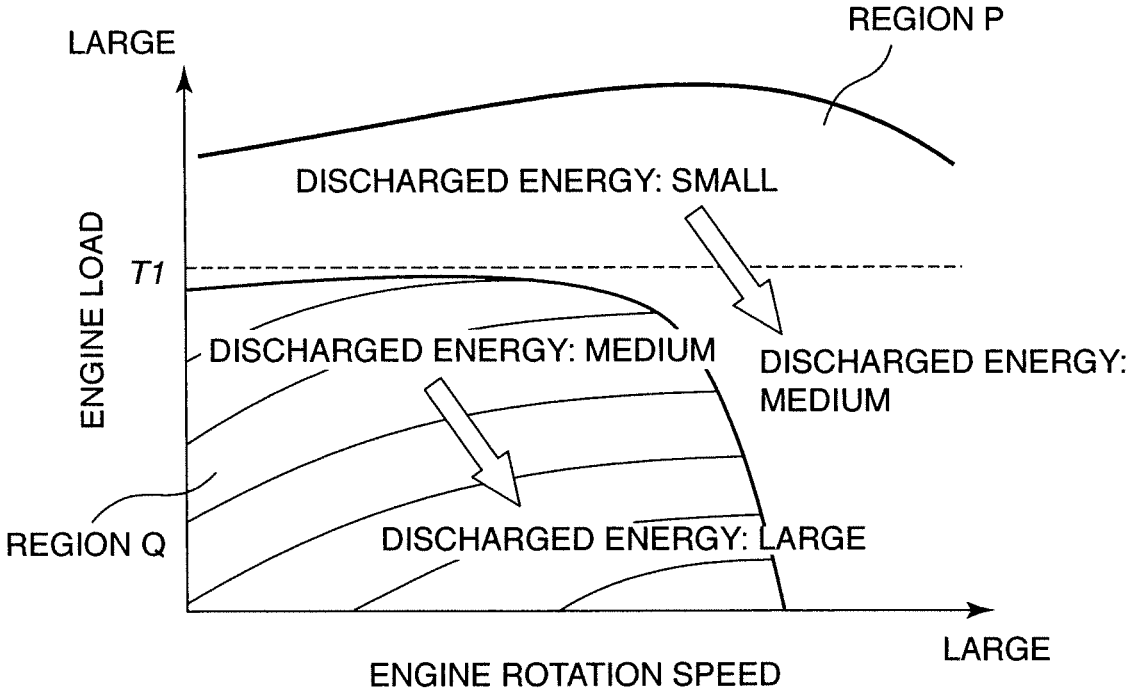
FIG. 21 is a diagram illustrating a content of a discharged energy map stored in a controller according to the seventh embodiment of this invention.

Referring to FIG. 21, the operation range of the internal combustion engine 101 can be divided into the region P where high-rotation-speed/high-load operation is conducted and the region Q where low-rotation-speed/low-load operation is conducted.

Figure 22A:
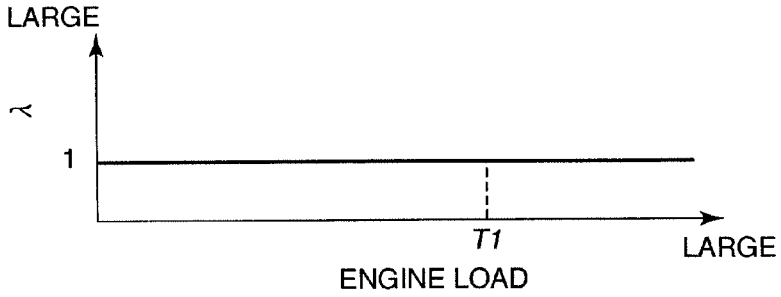
FIGS. 22A-22C are diagrams illustrating the excess air factor, the EGR ratio, and the IVC timing in an operation range of high-engine-rotation-speed/high-engine-load in the internal combustion engine equipped with the ignition device according to the seventh embodiment of this invention.
Figure 22B:
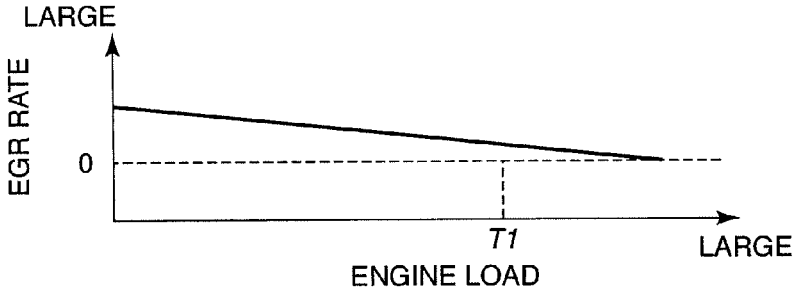

Referring to FIG. 22A, in the region P, the fuel injection amount is controlled such that the excess air factor λ is equal to 1.0, or in other words the air-fuel ratio is equal to the stoichiometric air-fuel ratio, irrespective of the engine operation state, Referring to FIG. 22B, in the region P, the EGR rate is controlled according to the engine load, and the internal combustion engine 101 performs diluted combustion. The EGR rate in the region P is set so as to decrease as the engine load increases.

Figure 22C:
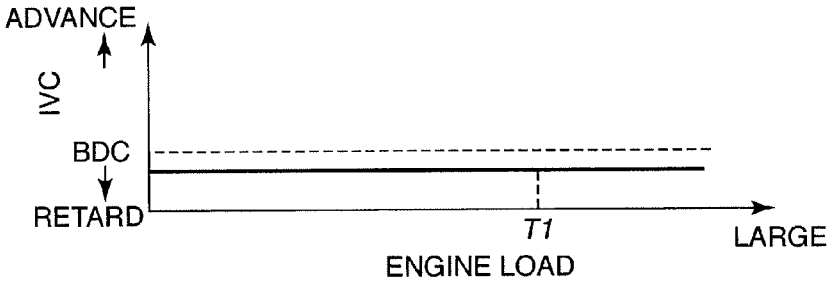

Referring to FIG. 22C, in the region P, the intake valve close (IVC) timing for the intake valve 31 is set to be retarded from the piston bottom dead center.

In addition, in the region P, where the internal combustion engine 101 performs high-rotation-speed/high-load operation, performing diluted combustion results in deterioration in the ignition performance for the fuel mixture. In the region P, the controller 70 adjusts the voltage value, the wave number, etc. of the impressed alternating current as the engine load decreases and the engine rotation speed increases as shown in FIG. 21 to increase the discharged energy of the non-equilibrium plasma discharge, thereby stabilizing the ignition performance. However, the discharged energy of the non-equilibrium plasma discharge of the spark plug 50 in the region P is set smaller than that in the region Q.

Figure 23A:
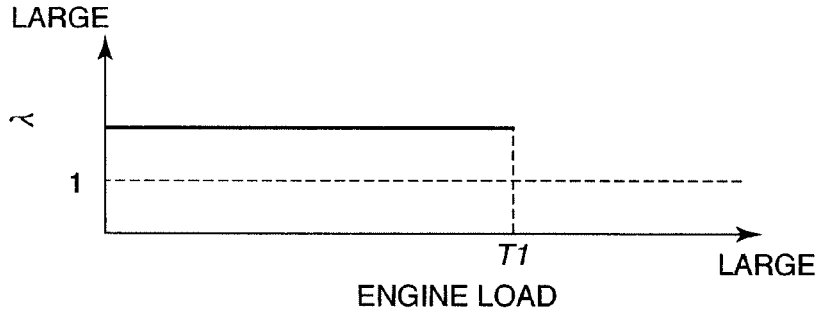
FIGS. 23A-23C are diagrams illustrating the excess air factor, the EGR ratio, and the IVC timing in an operation range of low-engine-rotation-speed/low-engine-load in the internal combustion engine equipped with the ignition device according to the seventh embodiment of this invention.

Referring to FIG. 23A, in the region Q, the fuel injection amount of the internal combustion engine 101 is controlled such that the excess air factor λ is equal to 2, and the internal combustion engine 101 performs lean burn.

Figure 23B:
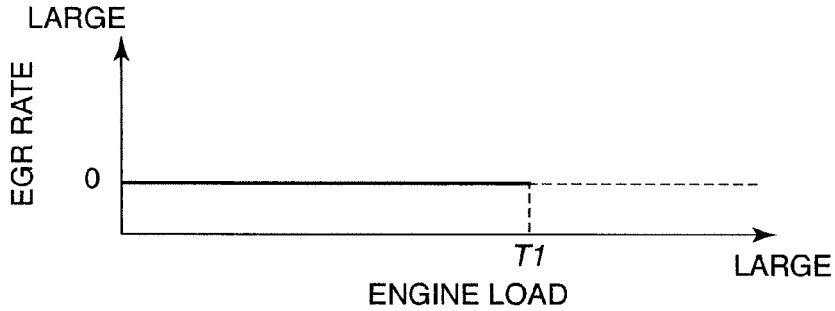

Referring to FIG. 23B, in the region Q, the internal combustion engine 101 performs lean burn while keeping the EGR rate at zero. or in other words while performing no EGR.

Figure 23C:
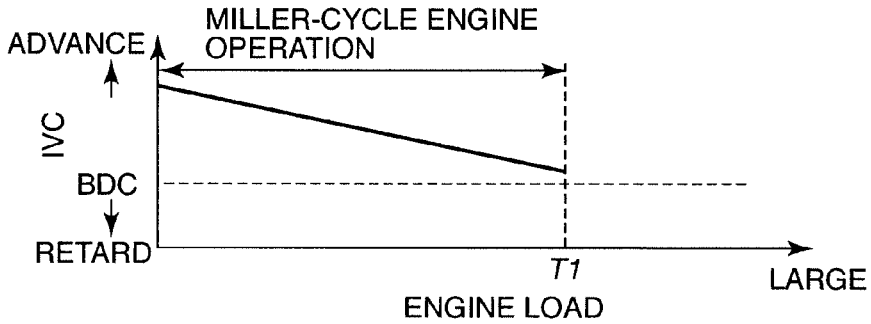

Referring to FIG. 23C, in the region Q, the internal combustion engine 101 performs Miller-cycle engine operation. In Miller-cycle engine operation, the advancement amount of the IVC timing is controlled to be advanced as the engine load decreases, thereby stopping the intake of fuel mixture during the intake stroke.

The excess air factor λ, the EGR rate, and the IVC timing of the internal combustion engine 10*q* are controlled by a control device provided as a separate unit, but it is also possible to set up the controller 70 to control these factors.

When, in the region Q, the internal combustion engine 101 conducts Miller-cycle engine operation while performing lean burn, the ignition performance for the fuel mixture deteriorates as compared with that in the region P. To remedy this deterioration, the controller 70 sets the discharged energy of the non-equilibrium plasma discharge of the spark plug 50 in the region Q larger than that in the region P. Further, also in the region Q, the controller 70 controls the voltage value, the wave number, etc. of the impressed alternating current such that the discharged energy of the non-equilibrium plasma discharge increases as the engine load decreases and the engine rotation speed increases. In this way, the discharged energy of the spark plug 50, which effects volumetric ignition on the fuel mixture in the combustion chamber 13, is increased, thereby stabilizing the ignition performance.

Further, in this embodiment, radical of high reactivity is generated in the combustion chamber 13 prior to the volumetric ignition of the fuel mixture by the spark plug 50, thereby achieving a further improvement in terms of ignition performance.

Figure 24:
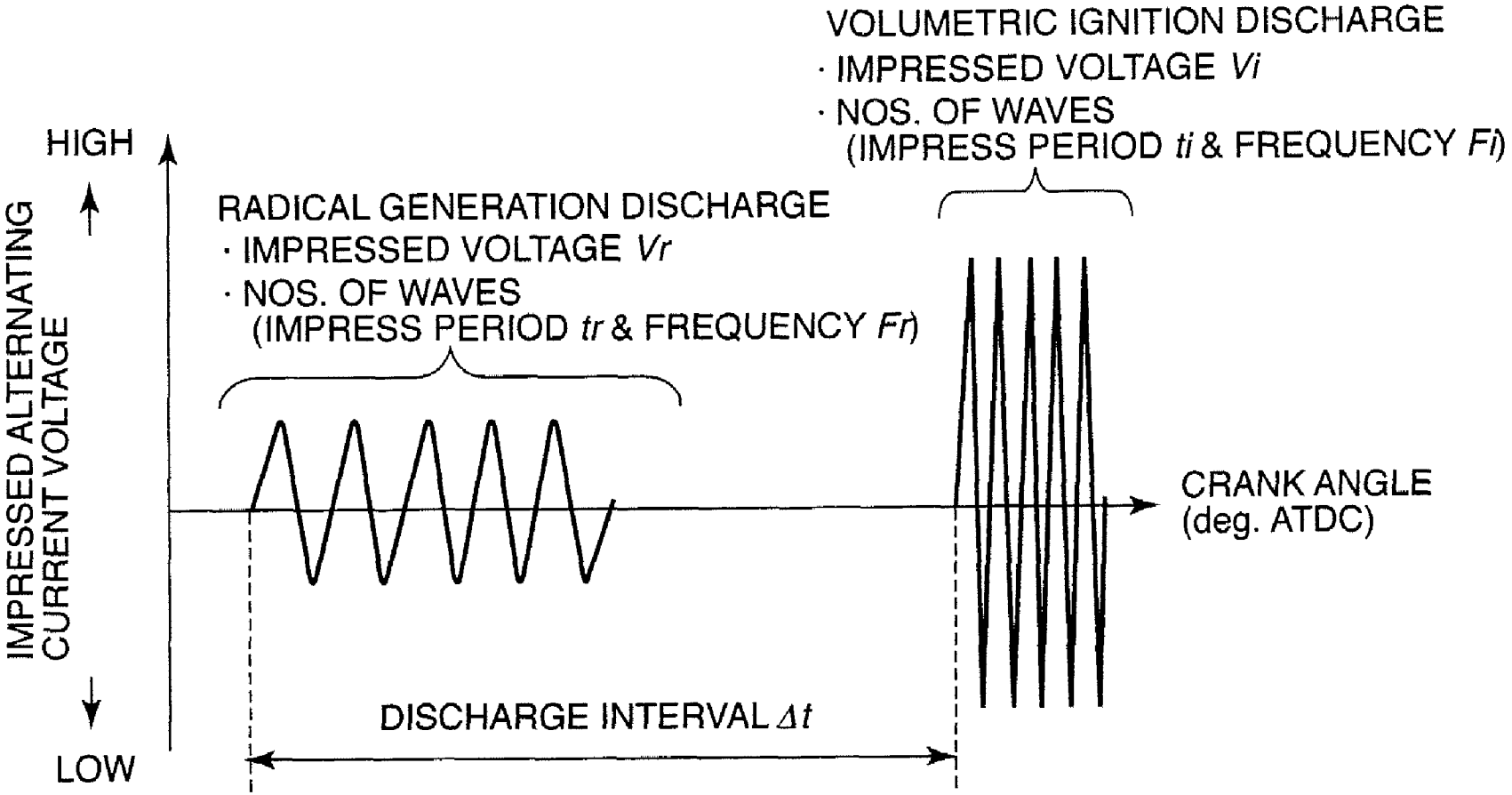
FIG. 24 is a timing chart illustrating radical generation discharge executed by the ignition device according to the seventh embodiment of this invention.
Figure 25:
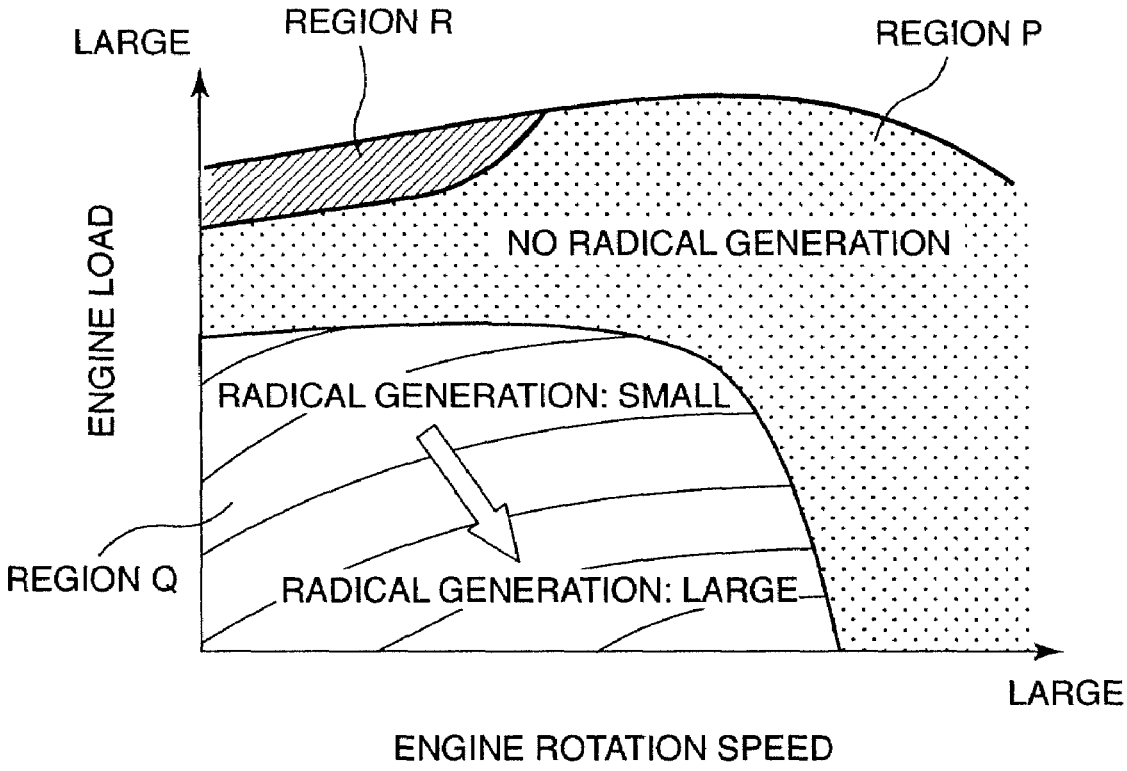
FIG. 25 is a diagram illustrating a content of a radical generation discharge region map stored in the controller according to the seventh embodiment of this invention.

Referring to FIGS. 24 and 25, the radical generated in the combustion chamber 13 will be described.

Referring to FIG. 24, prior to volumetric ignition discharge, the spark plug 50 executes radial generation discharge between the center electrode 51 and the insulating member 11*c* of the piston 11, generating radical within the combustion chamber 13. The radical generated is a chemical species of high reactivity, which promotes the combustion in the combustion chamber 13 at the time of volumetric ignition. The radical generation amount increases as the discharged energy amount in the radical generation increases. However, when the discharged energy is excessively large, volumetric ignition occurs earlier than expected. The controller 70 therefore controls the voltage value, the wave number, etc. of the impressed alternating current of the spark plug 50 such that the discharged energy of the radical generation discharge is smaller than the discharge energy at the time of volumetric ignition.

The radical generated through radical generation discharge allows variation in the distribution thereof within the combustion chamber 13 through adjustment of the discharge interval Δt from the discharge start of the radical generation discharge to the discharge start of the volumetric ignition discharge. When the discharge interval Δt is short, the volumetric ignition discharge is effected immediately after the radical generation discharge, and the radical is distributed solely in the vicinity of the center electrode 51. When the discharge interval Δt is long, the radical generated is diffused, and is widely distributed within the combustion chamber 13.

In this embodiment, the radical generation discharge is executed based on the operation map, the contents of which are shown in FIG. 25.

Referring to FIG. 25, in the region Q, where low-rotation-speed/low-load operation is conducted, the controller 70 causes the spark plug 50 to execute radical generation discharge, generating radical within the combustion chamber 13. In the region Q, where Miller-cycle engine operation is conducted, the controller 70 controls the voltage value, the wave number, etc. of the impressed alternating current such that the discharged energy of the radical generation discharge increases as the engine load decreases and the engine rotation speed increases, thereby stabilizing the ignition performance.

On the other hand, in the region P, where high-rotation-speed/high-load operation is conducted, basically no radical generation discharge is executed. However, with respect to the low-rotation-speed/high-load region R, where knocking is likely to occur, it is also preferable to effect radical generation discharge by the spark plug 50 to generate radical within the combustion chamber 13. In the region R, the discharge interval Δt is set large such that the radical is distributed widely within the combustion chamber 13, thereby increasing the flame propagation speed at the time of combustion so as to prevent knocking from being generated.

In the ignition device according to this embodiment, the non-equilibrium plasma discharge is effected between the center electrode 51 of the spark plug 50 and the insulating member 11*c* of the piston 11, thereby effecting volumetric ignition on the fuel mixture in the combustion chamber 13. Thus, even under a condition likely to lead to unstable combustion, as in the case of lean burn or diluted combustion, it is possible to attain a sufficiently large heat generation, thus improving the ignition performance of the ignition device and making it possible to shorten the combustion period.

In this embodiment, in the region Q, where low-rotation-speed/low-load operation is conducted, radical generation discharge is further conducted prior to the volumetric ignition discharge by the spark plug 50, thereby generating, within the combustion chamber 13, radical which promotes ignition. Thus, it is possible to further improve the ignition performance of the ignition device, making it possible to further expand the lean burn limit as compared with the first embodiment.

Further, in this embodiment, with respect to the region P, the discharge interval Δt is set large in the operation region R, where knocking is likely to occur, and then radical generation discharge is executed, thereby distributing the radical widely within the combustion chamber 13. The distributed radical increases the flame propagation speed at the time of combustion, which suppresses generation of knocking in the internal combustion engine 101.

The contents of Tokugan 2007-201985, with a filing date of Aug. 2, 2007 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

For example, the first through seventh embodiments are applied to a four-stroke-cycle reciprocating engine, but this invention is also applicable to a two-stroke-cycle engine.

The first through seventh embodiments described above are applied to a port injection type internal combustion engine, in which the fuel injector 34 is arranged at the intake port 30, but this invention is also applicable to a in-cylinder direct injection type engine, in which fuel is directly injected into the combustion chamber.

Further, in the first through seventh embodiments, the discharged energy may be set based on any of the operation maps corresponding to those shown in FIG. 7A, FIG. 16, and FIG. 21.

While, in the sixth embodiment, the IVC timing is advanced with respect to the piston bottom dead center, and the intake of fuel mixture is stopped during the intake stroke to thereby vary the intake amount of fuel mixture, it is also possible to vary the intake amount of fuel mixture by retarding the IVC timing with respect to the piston bottom dead center.

The embodiments of this invention in which an exclusive property or privilege is claimed are defined as follows:

What is claimed is:

1. An ignition device which performs a non-equilibrium plasma discharge ignition of a fuel mixture in a combustion chamber of an internal combustion engine comprising:

a first electrode;

a second electrode;

an insulating member which is formed from a dielectric substance, interposed between the first electrode and the second electrode, and which promotes non-equilibrium plasma discharge between the insulating member and one of the first electrode and the second electrode when an alternating current is impressed between the first electrode and the second electrode; and an alternating current impressing device which is configured to control a discharged energy of non-equilibrium plasma discharge;

wherein the internal combustion engine performs operation in a first operation region in which an engine rotation speed is not greater than a predetermined speed and an engine load is not greater than a predetermined load, and in a second operation region in which the engine rotation speed or the engine load is greater than that of the first operation region, and wherein the alternating current impressing device is configured to:

set the discharged energy of the non-equilibrium plasma discharge in the first operation region greater than the discharged energy of the non-equilibrium plasma discharge in the second operation region; and set the discharged energy of the non-equilibrium plasma discharge to increase as the engine load decreases and the engine rotation speed increases in the first operation region.

2. The ignition device as defined in claim 1, wherein the alternating current impressing device is further configured to set the discharged energy of the non-equilibrium plasma discharge at a fixed level state in the second operation region irrespective of an engine operation.

3. The ignition device as defined in claim 1, wherein the alternating current impressing device is further configured to set the discharged energy of the non-equilibrium plasma discharge to increase as the engine load decreases and the engine rotation speed increases in the second operation region.

4. The ignition device as defined in claim 1, wherein the alternating current impressing device is further configured to execute radical generation discharge along with the non-equilibrium plasma discharge in the first operation region.

5. The ignition device as defined in claim 4, wherein the alternating current impressing device is further configured to increase a discharged energy of the radical generation discharge as the engine load decreases and the engine rotation speed increases in the first operation region.

6. The ignition device as defined in claim 4, wherein the alternating current impressing device is further configured not to execute radical generation discharge in the second operation region.

7. The ignition device as defined in claim 4, wherein the alternating current impressing device is further configured to execute radical generation discharge in a specific low-rotation-speed/high-load region within the second operation region.

8. The ignition device as defined in claim 1, wherein the alternating current impressing device is further configured to increase the discharged energy of the non-equilibrium plasma discharge as the engine rotation speed increases, by increasing a frequency of the alternating current impressed between the first electrode and the second electrode.

* * * * *